US010012939B2

(12) United States Patent
Nishimura et al.

(10) Patent No.: US 10,012,939 B2
(45) Date of Patent: Jul. 3, 2018

(54) IMAGE FORMING APPARATUS AND PROGRAM PRODUCT USED IN THE IMAGE FORMING APPARATUS

(71) Applicants: Takayuki Nishimura, Kanagawa (JP); Hideyo Makino, Tokyo (JP); Yasuyuki Sekino, Kanagawa (JP); Kohtaroh Oda, Kanagawa (JP); Tohru Matsumoto, Kanagawa (JP); Yuji Karikusa, Kanagawa (JP); Yukifumi Kobayashi, Kanagawa (JP); Kohsuke Yoshida, Kanagawa (JP); Daiki Sekita, Kanagawa (JP); Yuusuke Kumagawa, Kanagawa (JP); Hiroki Terauchi, Kanagawa (JP)

(72) Inventors: Takayuki Nishimura, Kanagawa (JP); Hideyo Makino, Tokyo (JP); Yasuyuki Sekino, Kanagawa (JP); Kohtaroh Oda, Kanagawa (JP); Tohru Matsumoto, Kanagawa (JP); Yuji Karikusa, Kanagawa (JP); Yukifumi Kobayashi, Kanagawa (JP); Kohsuke Yoshida, Kanagawa (JP); Daiki Sekita, Kanagawa (JP); Yuusuke Kumagawa, Kanagawa (JP); Hiroki Terauchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/289,312

(22) Filed: Oct. 10, 2016

(65) Prior Publication Data

US 2017/0131671 A1 May 11, 2017

(30) Foreign Application Priority Data

Nov. 6, 2015 (JP) ..... 2015-218915

(51) Int. Cl.
*G03G 15/00* (2006.01)

(52) U.S. Cl.
CPC ..... *G03G 15/5062* (2013.01)

(58) Field of Classification Search
CPC ..... G03G 15/5054; G03G 15/5062; G03G 15/5095; G03G 15/041; G03G 15/23; G03G 15/231; G03G 15/232
See application file for complete search history.

(56) References Cited

U.S. PATENT DOCUMENTS 4,623,778 A * 11/1986 Cullen ..... B23Q 35/128 219/124.34
6,106,448 A * 8/2000 Obara ..... B31B 50/00 493/11

(Continued)

FOREIGN PATENT DOCUMENTS

JP 4-323066 11/1992
JP 2000-305324 11/2000

(Continued)

*Primary Examiner* — David Banh
(74) *Attorney, Agent, or Firm* — Harness, Dickey & Pierce, P.L.C.

(57) ABSTRACT

An image forming apparatus includes an image forming device configured to form a first image on a first side of a recording medium and a second image on a second side of the recording medium, a position detector configured to detect respective positions of the first and second images, and a controller configured to perform, based on detection results obtained by the position detector, at least one of an image position correction by matching the first and second images and a magnification error correction by calculating and correcting a magnification error of one of the first and second images relative to the other. A program product used in the image forming apparatus includes a method of forming the first image and the second image, detecting the (Continued)

respective positions of the first and second images, and matching a position or a size of the first and second images.

20 Claims, 23 Drawing Sheets

(56) References Cited

U.S. PATENT DOCUMENTS 6,266,151 B1* 7/2001 Tachibana ..... B41J 13/0018 358/1.12
2003/0043256 A1* 3/2003 Conrow ..... H04N 1/00031 347/248
2010/0329756 A1* 12/2010 Mizes ..... G03G 15/0131 399/364
2011/0304090 A1* 12/2011 Kimura ..... B42C 1/12 270/58.11
2012/0237226 A1* 9/2012 Saka ..... G03G 15/5029 399/16
2012/0291299 A1* 11/2012 Kudo ..... G01B 5/02 33/772
2013/0049287 A1* 2/2013 Ueda ..... G03G 15/231 271/110
2013/0049296 A1* 2/2013 Takai ..... B65H 7/14 271/227
2013/0050320 A1* 2/2013 Duke ..... B41J 3/60 347/14
2013/0050329 A1* 2/2013 Duke ..... B41J 3/60 347/19
2013/0195482 A1* 8/2013 Nakura ..... B65H 5/06 399/45
2013/0228969 A1* 9/2013 Nakura ..... B41J 13/0009 271/272
2013/0251434 A1* 9/2013 Ueda ..... G03G 15/0189 399/388
2013/0278945 A1* 10/2013 Ono ..... G03G 15/041 358/1.2
2014/0029961 A1* 1/2014 Ueda ..... G03G 15/0131 399/16
2014/0037299 A1* 2/2014 Nakura ..... G03G 15/607 399/16
2015/0116412 A1* 4/2015 Duke ..... B41J 11/008 347/19
2015/0116413 A1* 4/2015 Duke ..... B41J 29/393 347/19

FOREIGN PATENT DOCUMENTS

| | | |
|---|---|---|
| JP | 2001-066948 | 3/2001 |
| JP | 2001-282053 | 10/2001 |
| JP | 2001-326785 | 11/2001 |
| JP | 2002-189381 | 7/2002 |
| JP | 2002-326399 | 11/2002 |
| JP | 2004-163629 | 6/2004 |
| JP | 2004-271739 | 9/2004 |
| JP | 2006-072116 | 3/2006 |
| JP | 2006-145685 | 6/2006 |
| JP | 2006-255949 | 9/2006 |
| JP | 2007-168922 | 7/2007 |
| JP | 2007-201703 | 8/2007 |
| JP | 2008-023807 | 2/2008 |
| JP | 2014-077977 | 5/2014 |

* cited by examiner

FIG. 2A

5-SHEET INTERLEAF CONTROL

| | FIRST SIDE CONSECUTIVE PRINTING PERIOD | | | | | | | | ALTERNATE PRINTING PERIOD | | | | | | | | SECOND SIDE CONSECUTIVE PRINTING PERIOD | | | | | | | |
|---|---|---|---|---|---|---|---|---|---|---|---|---|---|---|---|---|---|---|---|---|---|---|---|---|
| IN : FIRST SIDE | (1) | g1 | (2) | g1 | (3) | g1 | (4) | g1 | (5) | | (6) | | (7) | | (8) | | | | | | | | | |
| OUT : SECOND SIDE | | | | | | | | | | (1) | | (2) | | (3) | | (4) | g2 | (5) | g2 | (6) | g2 | (7) | g2 | (8) |

FIG. 2B

4-SHEET INTERLEAF CONTROL

| | FIRST SIDE CONSECUTIVE PRINTING PERIOD | | | | | | | ALTERNATE PRINTING PERIOD | | | | | | | | SECOND SIDE CONSECUTIVE PRINTING PERIOD | | | | | | |
|---|---|---|---|---|---|---|---|---|---|---|---|---|---|---|---|---|---|---|---|---|---|---|
| IN : FIRST SIDE | (1) | g1 | (2) | g1 | (3) | g1 | (4) | | (5) | | (6) | | (7) | | (8) | | | | | | | |
| OUT : SECOND SIDE | | | | | | | | (1) | | (2) | | (3) | | (4) | | (5) | g2 | (6) | g2 | (7) | g2 | (8) |

FIG. 2C

3-SHEET INTERLEAF CONTROL

| | FIRST SIDE CONSECUTIVE PRINTING PERIOD | | | | | | | | ALTERNATE PRINTING PERIOD | | | | | | | | SECOND SIDE CONSECUTIVE PRINTING PERIOD | | | |
|---|---|---|---|---|---|---|---|---|---|---|---|---|---|---|---|---|---|---|---|---|
| IN : FIRST SIDE | (1) | g1 | (2) | g1 | (3) | | (4) | | (5) | | (6) | | (7) | | (8) | | | | | |
| OUT : SECOND SIDE | | | | | | (1) | | (2) | | (3) | | (4) | | (5) | | (6) | g2 | (7) | g2 | (8) |

IMAGE FORMING APPARATUS AND PROGRAM PRODUCT USED IN THE IMAGE FORMING APPARATUS

CROSS-REFERENCE TO RELATED APPLICATION

This patent application is based on and claims priority pursuant to 35 U.S.C. § 119(a) to Japanese Patent Application No, 2015-218915, filed on Nov. 6, 2015, in the Japan Patent Office, the entire disclosure of which is hereby incorporated by reference herein.

BACKGROUND

Technical Field

This disclosure relates to an image forming apparatus and a program product used in the image forming apparatus.

Related Art

Electrophotographic image forming apparatuses are known to form an image on both sides of a recording medium.

In such an image forming apparatus, for example, an image is formed together with a detection mark on a first side of a recording sheet. The detection mark on the first side is detected to obtain a change in magnification to image data of the image formed on the first side and a position of the image on the first side. Based on the detected position of the image, an image forming time is corrected, so that an image to be formed on a second side of the recording sheet is aligned with the position of the image formed on the first side. In addition, based on the detected change in magnification, a magnification of image data to be formed on the second side of the recording sheet is corrected, so that a size of the image to be formed on the second side is matched with a size of the image formed on the first side. After these adjustments, image formation is started at the corrected image forming time. At the same time, based on the image data with the corrected magnification, an image is formed on the second side of the recording sheet conveyed again to an image forming position via a sheet reversing passage. Accordingly, the position and size of the image formed on the first side of the recording sheet are matched with the position and size of the image formed on the second side.

SUMMARY

At least one aspect of this disclosure provides an image forming apparatus including an image forming device configured to form a first image on a first side of a recording medium and a second image on a second side of the recording medium, a position detector disposed downstream from the image forming device in a sheet conveying direction to detect a position of the first image on the first side of the recording medium and a position of the second image on the second side of the recording medium, and a controller configured to perform, based on detection results obtained by the position detector; at least one of an image position correction in which the first image on the first side and the second image on the second side are matched and a magnification error correction in which a magnification error of one of the first image on the first side of the recording medium and the second image on the second side of the recording medium is calculated and corrected.

Further, at least one aspect of this disclosure provides a program product used in the image forming apparatus including a method of forming a first image on a first side of a recording medium and a second image on a second side of the recording medium, detecting a position of the first image and a position of the second image, and matching at least one of a position and a size of the first image and the second image on the second side based on a detection result of the detecting.

BRIEF DESCRIPTION OF THE SEVERAL VIEWS OF THE DRAWINGS

FIG. 2A is a diagram illustrating an example of a 5-sheet interleaf control;

FIG. 2B is a diagram illustrating an example of a 4-sheet interleaf control;

FIG. 2C is a diagram illustrating an example of a 3-sheet interleaf control;

DETAILED DESCRIPTION

Figure 1:
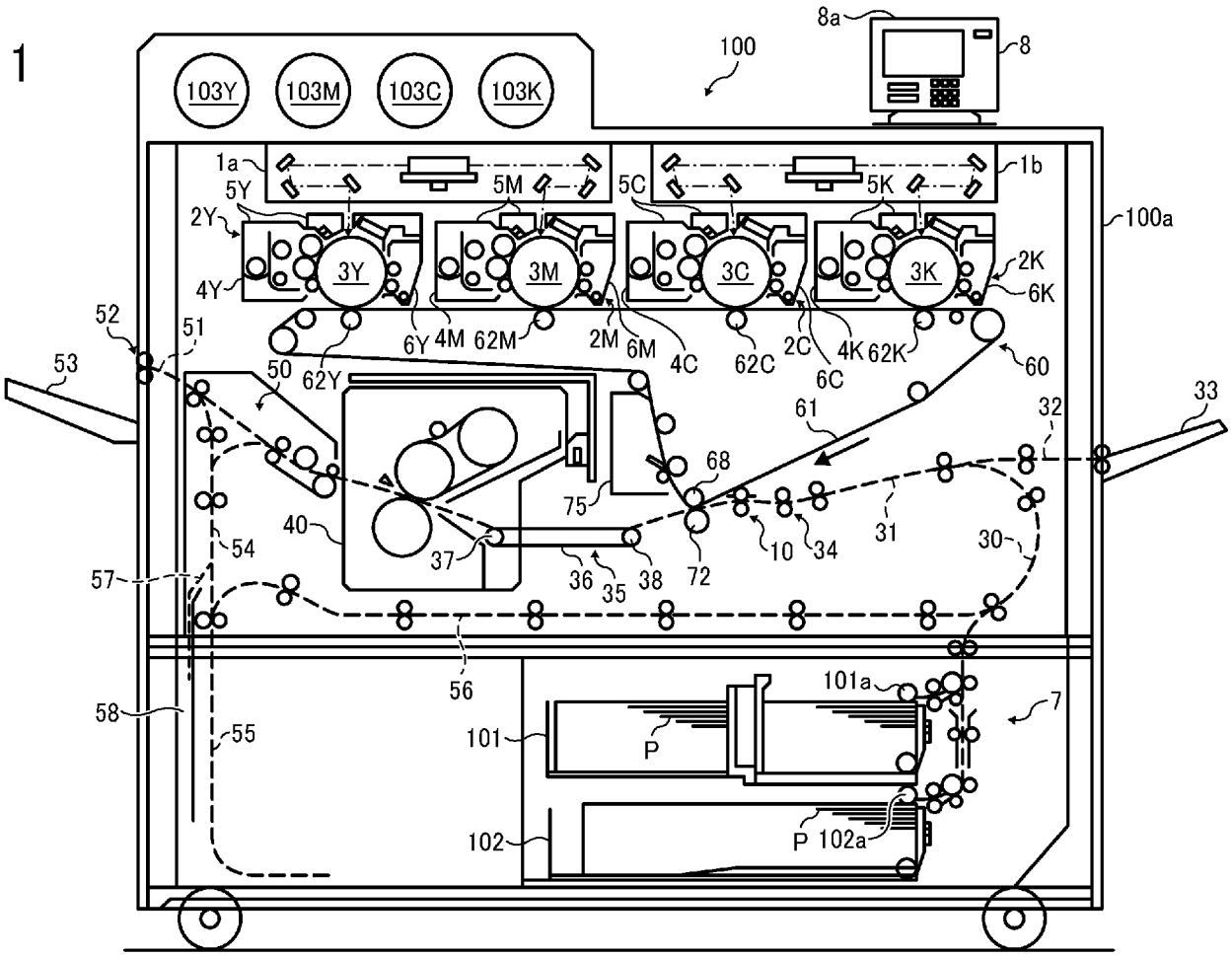
FIG. 1 is a schematic arrangement of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a configuration of an electrophotographic image forming apparatus for forming an image, according to the present embodiment of this disclosure.

A description is given of a basic configuration of the image forming apparatus 100 according to an example of this disclosure.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

FIG. 1 is a schematic diagram illustrating an entire configuration of the image forming apparatus 100 according to an embodiment of this disclosure.

The image forming apparatus 100 includes two optical writing devices 1YM and 1CK, and four process units 2Y, 2M, 2C, and 2K to form respective toner images of yellow (Y), magenta (M), cyan (C), and black (K). The process units 2Y, 2M, 2C, and 2K function as an image forming device. Further, the image forming apparatus 100 includes a sheet feeding passage 30, a pre-transfer sheet conveying passage 31, a bypass sheet feeding passage 32, a bypass tray 33, a pair of registration rollers 34, a transfer belt device 35, a fixing device 40, a conveyance direction switching device 50, a sheet ejecting passage 51, a pair of sheet output rollers 52, a sheet output tray 53, a sheet feeding device 7, and a sheet re-entry device.

The sheet feeding device 7 functions as a sheet feeder and includes a first sheet container 101 and a second sheet container 102. Both the first sheet container 101 and the second sheet container 102 function as a sheet loader. Each of the first sheet container 101 and the second sheet container 102 contains a bundle of recording sheets P that function as recording media. The bundle of recording sheets P includes a recording sheet P that functions as a recording medium. The first sheet container 101 includes a first sheet feed roller 101*a* and the second sheet container 102 includes a second sheet feed roller 102*a*, Each of the first sheet feed roller 101*a* and the second sheet feed roller 102*a* functions as a sheet moving body. The recording sheet P that is placed on top of the bundle of recording sheets P is fed by rotation of a selected one of the first sheet feed roller 101*a* and the second sheet feed roller 102*a* toward the sheet feeding passage 30. The sheet feeding passage 30 leads to the pre-transfer sheet conveying passage 31 that extends to a secondary transfer nip region. The recording sheet P passes through the pre-transfer sheet conveying passage 31 toward the secondary transfer nip region. After having been ted from a selected one of the first sheet container 101 and the second sheet container 102 and having passed through the sheet feeding passage 30, the recording sheet P enters the pre-transfer sheet conveying passage 31.

The bypass tray 33 is disposed on a side of a housing 100*a* of the image forming apparatus 100 to be openably closable to the housing 100*a*. The bundle of recording sheets P can be loaded on a top face of the bypass tray 33 when the bypass tray 33 is separated to open from the housing 100*a*. The recording sheet P placed on top of the bundle of recording sheets P on the bypass tray 33 is fed by a sheet feed roller included in the bypass tray 33 toward the pre-transfer sheet conveying passage 31.

Each of the optical writing devices 1*a* and 1*b* includes a laser diode, a polygon mirror, various lenses, and so forth. Based on image data that is optically read by a scanner disposed outside the housing 100*a* or image data output from a personal computer disposed outside the housing 100*a*, each of the optical writing devices 1*a* and 1*b* emits laser light from a laser diode to optically scan photoconductors 3Y, 3M, 3C, and 3K of the process units 2Y, 2M, 2C, and 2K, respectively. Specifically, a drive device drives the photoconductors 3Y, 3M, 3C, and 3K of the process units 2Y, 2M, 2C, and 2K to rotate in a counterclockwise direction in FIG. 1. The optical writing device 1YM emits laser light to the photoconductors 3Y and 3M by deflecting in an axial direction of rotation of the photoconductors 3Y and 3M. Accordingly, respective surfaces of the photoconductors 3Y and 3M are optically scanned and irradiated. Accordingly, an electrostatic latent image based on Y image data is formed on the photoconductor 3Y and M image data is formed on the photoconductor 3M. Further, the optical writing device 1CK emits laser light to the photoconductors 3C and 3K by deflecting in an axial direction of rotation of the photoconductors 3C and 3K. Accordingly, respective surfaces of the photoconductors 3C and 3K are optically scanned and irradiated. Accordingly, an electrostatic latent image based on C image data is formed on the photoconductor 3C and M image data is formed on the photoconductor 3K.

The process units 2Y, 2M, 2C, and 2K include photoconductors 3Y. 3M, 3C, and 3K function as a latent image bearer, respectively. The process units 2Y, 2M, 2C, and 2K also include respective image forming components disposed around each of the photoconductors 3Y 3M, 3C, and 3K as a single unit, respectively. The process units 2Y, 2M, 2C, and 2K are detachably attached to the housing 100*a* of the image forming apparatus 100. The process units 2Y, 2M, 2C, and 2K have respective configurations identical to each other except the colors of toners, and therefore are occasionally described without suffixes indicating the toner colors, which are Y, M, C, and K.

The process units 2Y, 2M, 2C, and 2K have respective configurations identical to each other except the colors of toners, and therefore are occasionally described without suffixes indicating the toner colors, which are Y, M, C, and K.

The process unit 2 (i.e., the process units 2Y 2M, 2C, and 2K) includes the photoconductor 3 (i.e., the photoconductors 3Y, 3M, 3C, and 3K), a developing device 4 (i.e., developing devices 4Y, 4M, 4C, and 4K), a charging device 5 (i.e., charging devices 5Y, 5M, 5C, and 5K), and a drum cleaning device 6 (i.e., drum cleaning devices 6Y, 6M, 6C, and 6K). The developing device 4 supplies toner to an electrostatic latent image formed on the photoconductor 3 to develop the electrostatic latent image into a visible toner image. The charging device 5 uniformly charges a surface of the photoconductor 3 while the photoconductor 3 is in rotation. The drum cleaning device 6 removes residual toner remaining on the surface of the photoconductor 3 after passing through a primary transfer nip region.

In FIG. 1, the image forming apparatus 100 is a tandem image forming apparatus in which the process units 2Y, 2M, 2C, and 2K are aligned along a direction in which an intermediate transfer belt 61 moves endlessly.

A cylindrical drum part of the photoconductor 3 is manufactured by a hollow aluminum tube with a front face thereof covered by an organic photoconductive layer. It is to be noted that the photoconductor 3 may include an endless belt.

The developing device 4 develops an electrostatic latent image by a two-component developer including magnetic carrier particles and non-magnetic toner. Hereinafter, the two-component developer is simply referred to as a "developer". Instead of the two-component developer, the developing device 4 may include a one-component developer that does not include magnetic carrier particles.

A toner supplier replenishes corresponding color toner to a toner bottle 103 toner bottles 103Y, 103M, 1030, and 103K).

The drum cleaning device 6 in the present embodiment of this disclosure includes a cleaning blade of polyurethane rubber as a cleaning body to be pressed against the photoconductor 3. However, the configuration is not limited thereto. Further, in order to enhance the cleaning performance, the image forming apparatus 100 employs a rotatable fur brush to contact the photoconductor 3. This fur brush scrapes a solid lubricant into powder and applies the lubricant powder to the surface of the photoconductor 3.

An electric discharging lamp is disposed above the photoconductor 3. The electric discharging lamp is also included in the process unit 2. Further, the electric discharging lamp optically emits light to the photoconductor 3 to remove electricity from the surface of the photoconductor 3 after passing through the drum cleaning device 6. The discharged surface of the photoconductor 3 is uniformly charged by the charging device 5. Then, the above-described optical writing device 1YM starts optical scanning.

It is to be noted that the charging device 5 rotates while receiving the charging bias from a power source. Instead of this configuration, the charging device 5 can employ a scorotron charging system in which a charging operation is performed without contacting the photoconductor 3.

As previously described with FIG. 1, the process units 2Y, 2M, 2C, and 2K have an identical configuration to each other.

A transfer device 60 is disposed below the process units 2Y, 2M, 2C, and 2K. The transfer device 60 causes the intermediate transfer belt 61 that is wound around multiple support rollers with tension. In the transfer device 60, while being in contact with the photoconductors 3Y, 3M, 3C, and 3K, the intermediate transfer belt 61 is rotated by rotation of one of the multiple support rollers so that the intermediate transfer belt 61 endlessly moves in a clockwise direction. By so doing, respective primary transfer nip regions for forming yellow, magenta, cyan, and black images are formed between the photoconductors 3Y, 3M, 3C, and 3K and the intermediate transfer belt 61.

In the vicinity of the primary transfer nip regions, primary transfer rollers 62Y, 62M, 62C, and 62K are disposed in a space surrounded by an inner circumferential surface of the intermediate transfer belt 61, that is, in a belt loop. The primary transfer rollers 62Y, 62M, 62C, and 62K, each of which functioning a primary transfer body, presses the intermediate transfer belt 61 toward the photoconductors 3Y, 3M, 3C, and 3K. A primary transfer bias is applied by a transfer bias power supply to the primary transfer rollers 62Y, 62M, 62C, and 62K. Consequently, respective primary transfer electric fields are generated in the primary transfer nip regions to electrostatically transfer respective toner images formed on the photoconductors 3Y, 3M, 3C, and 3K onto the intermediate transfer belt 61.

As the intermediate transfer belt 61 passes through the primary transfer nip regions along with the endless rotation, the yellow, magenta, cyan, and black toner images are sequentially transferred at the primary transfer nip regions and overlaid onto an outer circumferential surface of the intermediate transfer belt 61. This transferring operation is hereinafter referred to as primary transfer. Due to the primary transfer for primarily transferring the single color toner images, a composite toner image (hereinafter, referred to as a "four-color toner image") is formed on the outer circumferential surface of the intermediate transfer belt 61.

A secondary transfer roller 72 is disposed below the intermediate transfer belt 61 as illustrated in FIG. 1. The secondary transfer roller 72 that functions as a secondary transfer body contacts a secondary transfer backup roller 68 at a position at which the secondary transfer roller 72 faces the secondary transfer backup roller 68 via the outer circumferential surface of the intermediate transfer belt 61, which forms a secondary transfer nip region. By so doing, the secondary transfer nip region is formed between the outer circumferential surface the intermediate transfer belt 61 and the secondary transfer roller 72.

A secondary transfer bias is applied by a transfer bias power supply to the secondary transfer roller 72. By contrast, the secondary transfer backup roller 68 disposed inside the belt loop is electrically grounded. By so doing, a secondary transfer electric field is formed in the secondary transfer nip region.

The pair of registration rollers 34 is disposed on the right side of the secondary transfer nip region in FIG. 1. The pair of registration rollers 34 holds and conveys the recording sheet P to the secondary transfer nip region in synchronization with arrival of the four-color toner image formed on the intermediate transfer belt 61 so as to further convey the secondary transfer nip region to further convey the recording medium P toward the secondary transfer nip region. In the secondary transfer nip region, the four-color toner image formed on the intermediate transfer belt 61 is transferred onto the recording sheet P due to the secondary transfer electric field and a nip pressure. At this time, the four-color toner image is combined with white color of the recording medium P to make a full-color toner image.

Residual toner that is not transferred onto the recording sheet P in the secondary transfer nip region remains on the outer circumferential surface of the intermediate transfer belt 61 after the intermediate transfer belt 61 has passed through the secondary transfer nip region. A belt cleaning device 75 that contacts the intermediate transfer belt 61 removes the residual toner remaining on the outer circumferential surface of the intermediate transfer belt 61.

As the recording sheet P that has passed through the secondary transfer nip region separates from the intermediate transfer belt 61 to be conveyed to the transfer belt device 35. The transfer belt device 35 includes a transfer belt 36, a drive roller 37, and a driven roller 38. The transfer belt 36 having an endless belt is wound around the drive roller 37 and the driven roller 38 with taut and is endlessly rotated in a counterclockwise direction in FIG. 1 along with rotation of the drive roller 37. While holding the recording sheet P conveyed from the secondary transfer nip region on a stretched surface of an outer circumferential surface of the transfer belt 36, the transfer belt device 35 forwards the recording sheet P along with the endless rotation of the transfer belt 36 toward the fixing device 40.

The image forming apparatus 100 further includes a sheet reversing device including a conveyance direction switching device 50, a re-entry passage 54, a switchback passage 55, and a post-switchback passage 56. Specifically, after receiving the recording sheet P from the fixing device 40, the conveyance direction switching device 50 switches a direction of conveyance of the recording sheet P, in other words, a direction in which the recording sheet P is further conveyed, between the sheet ejecting passage 51 and the re-entry passage 54.

When printing an image on a first side of a recording sheet P and not printing on a second side, a single-side printing mode is selected. When performing a print job in the single-side printing mode, a route of conveyance of the recording sheet P is set to the sheet ejecting passage 51. According to the setting, the recording sheet P having an image on the first side is conveyed toward the pair of sheet output rollers 52 via the sheet ejecting passage 51 to be ejected to the sheet output tray 53 that is attached to the housing 100*a* of the image forming apparatus 100 from outside.

When printing images on both first and second sides of a recording sheet P, a duplex printing mode is selected. When performing a print job in the duplex printing mode, after the recording sheet having fixed images on both first and second sides is conveyed from the fixing device 40, a route of conveyance of the recording sheet P is set to the sheet ejecting passage 51. According to the setting, the recording sheet P having images on both first and second sides is conveyed toward the pair of sheet output rollers 52 via the sheet ejecting passage 51 to be ejected to the sheet output tray 53 that is attached to the housing 100*a* of the image forming apparatus 100 from outside. By contrast, when printing images on both first and second sides of the recording sheet P, a duplex printing mode is selected. When performing a print job in the duplex printing mode, after the recording sheet P having fixed images on both first and second sides is conveyed from the fixing device 40, a route of conveyance of the recording sheet P is set to the re-entry passage 54.

The re-entry passage 54 is connected to the switchback passage 55. The recording sheet P conveyed to the re-entry passage 54 enters the switchback passage 55.

Consequently, when the entire region in the sheet conveying direction of the recording sheet P enters the switchback passage 55, the direction of conveyance of the recording sheet P is reversed, so that the recording sheet P is switched back in the reverse direction. The switchback passage 55 is connected to the post-switchback passage 56 as well as the re-entry passage 54. The recording sheet P that has been switched back in the reverse direction enters the post-switchback passage 56. At this time, the faces of the recording sheet P are reversed. Consequently, the reversed recording sheet P is conveyed to the secondary transfer nip region again via the post-switchback passage 56 and the sheet feeding passage 30.

A toner image is transferred onto the second side of the recording sheet P in the secondary transfer nip region. Thereafter, the recording sheet P is conveyed to the fixing device 40 so as to fix the toner image to the second side of the recording sheet P. Then, the recording sheet P passes through the conveyance direction switching device 50, the sheet ejecting passage 51, and the pair of sheet output rollers 52 before being ejected on sheet output tray 53.

Further, in the present embodiment, a purge tray 58 is disposed at a lower part on the left side of the image forming apparatus 100 in FIG. 1. The purge tray 58 receives discharged sheets that are no longer to be used in the image forming apparatus 100. For example, a recording sheet that resides in the image forming apparatus 100 when the image forming apparatus 100 is stopped due to a failure such as paper jam. Specifically, the re-entry passage 54 is connected to a tray bound passage 57 through which the recording sheet P heading to the purge tray 58. When the recording sheet P is conveyed to the purge tray 58, the destination of conveyance of the recording sheet P is set to the tray bound passage 57. According to this configuration, the recording sheet P conveyed to the re-entry passage 54 is forwarded to the tray bound passage 57 before the post-switchback passage 56 and is eventually ejected to the purge tray 58.

In the present embodiment, when forming images in the duplex printing mode by the number of recording sheets P that exceeds a predetermined number of recording sheets P, the images are formed on both first and second sides of the recording sheet P in an interleaf control.

As described above, when forming images on both sides of the recording sheet P, a toner image is formed on the first side of the recording sheet P in the secondary transfer nip region. Then, the recording sheet P travels through the transfer belt device 35, the fixing device 40, the conveyance direction switching device 50, the re-entry passage 54, the switchback passage 55, and the post-switchback passage 56 before being conveyed to the sheet feeding passage 30 again. Then, a toner image is formed on the second side of the recording sheet P. Accordingly, the recording sheet P travels a long conveying route from where the toner image is transferred onto the first side of the recording sheet P in the secondary transfer nip region to where the recording sheet P returns to the sheet feeding passage 30, via the transfer belt device 35, the fixing device 40, the conveyance direction switching device 50, the re-entry passage 54, the switchback passage 55, and the post-switchback passage 56. As a result, it takes a long period of time from transfer of a toner image onto the first side of the recording sheet P to transfer of another toner image onto the second side of the recording sheet P. Specifically, in product printing apparatuses, enhancement in quality and productivity and handling in sheet types and thicknesses are highly expected. Therefore, modules for sheet conveyance, image formation, and image fixing in such product printing apparatuses may be greater in size than modules in office use printing apparatuses. As a result, a period of time from transfer of a toner image onto the first side of the recording sheet P to transfer of another toner image onto the second side of the recording sheet P becomes relatively long. Accordingly, forming images on both first and second sides of the recording sheet P takes a significantly long period of time.

In order to address this inconvenience, the present embodiment employs the interleaf control when forming images in the duplex printing mode by the number of recording sheets P that exceeds the predetermined number of recording sheets P. By so doing, deterioration in productivity can be restrained.

The interleaf control that is a sheet conveyance control is performed by a controller 20 that functions as a sheet conveyance controller. In the interleaf control, after an image is consecutively formed on the first side of a predetermined number of recording sheets, the controller 20 controls an alternate sheet conveying operation, i.e., the interleaf control, which is alternately performed between conveyance of the predetermined number of recording sheets having the image on the first side to the secondary transfer nip region and conveyance of a new recording sheet to the secondary transfer nip region.

FIGS. 2A, 2B, and 2C are diagrams illustrating examples of an interleaf control to form an image on eight (8) recording sheets consecutively conveyed in the duplex printing mode. Specifically, FIG. 2A is a diagram illustrating an example of a 5-sheet interleaf control, FIG. 2B is a diagram illustrating an example of a 4-sheet interleaf control, and FIG. 2C is a diagram illustrating an example of a 3-sheet interleaf control.

It is to be noted that "IN" in FIGS. 2A through 2C indicates entry of a recording sheet to the sheet reversing device and "OUT" indicates exit of the recording sheet from the sheet reversing device.

As the interleaf control starts, an image is consecutively formed on respective first sides of multiple recording sheets. In a 5-sheet interleaf control, five (5) recording sheets are temporarily stored inside the image forming apparatus 100. When the 5-sheet interleaf control is performed as illustrated in FIG. 2A, an image is formed on a first side of five recording sheets consecutively. When the 4-sheet interleaf control is performed as illustrated in FIG. 2B, an image is formed on a first side of four recording sheets consecutively. When the 3-sheet interleaf control is performed as illustrated in FIG. 2C, an image is formed on a first side of three recording sheets consecutively.

After a toner image is transferred onto the first side of a recording sheet, the number of recording sheets is generally changed under the interleaf control according to a distance of conveyance of the recording sheet to reach the secondary transfer nip region again and a position of the sheet tray selected for the print job.

The interleaf control has a first side consecutive printing period in which a toner image is formed on the first side of a predetermined number of recording sheets. As illustrated in FIGS. 2A through 2C, the first side consecutive printing period includes sheet gaps g1, each having a distance greater than a length of the recording sheet in the sheet conveying direction. The sheet gaps g1 are provided to convey a recording sheet that is switched back in the switchback passage 55 to be conveyed to the post-switchback passage 56 and a recording sheet that enters into the switchback passage 55 without colliding with each other. In addition, the recording sheets can be sequentially conveyed to the sheet feeding passage 30 without causing the post-switchback passage 56 to wait.

Then, after the toner images have consecutively been formed on the first side of the predetermined number of recording sheets, the interleaf control enters an alternate printing period in which new recording sheets that are sequentially fed from the selected sheet tray so as to form toner images on the first side and the reversed recording sheets that have toner images on the first side are alternately conveyed toward the secondary transfer nip region.

In the alternate printing period, each gap provided between two consecutive sheets is substantially same as a gap provided in the single-side printing mode. Therefore, the greatest consecutive productivity can be obtained in the duplex printing mode. As can be seen from FIGS. 2A, 2B, and 2C, the smaller the number of recording sheets for the interleaf control is, the more the period of time in the alternate printing period, and therefore the productivity can be more enhanced.

The interleaf control further has a second side consecutive printing period in which a toner image is consecutively formed on the second side of a predetermined number of recording sheets. After the eighth (8th) recording medium is fed from the sheet tray toward the secondary transfer nip region, the recording sheets are conveyed from the post-switchback passage 56. At this time, the toner images are consecutively formed on the second side of the recording sheets in the second side consecutive printing period. As illustrated in FIG. the second side consecutive printing period includes sheet gaps g2, each having a distance greater than the length of the recording sheet in the sheet conveying direction. However, the distance can be changed in the second side consecutive printing period. That is, for example, a speed of conveyance of the recording sheet that is passing through the post-switchback passage 56 is increased to reduce the distance of the sheet gaps g2, so that the recording sheets can be conveyed faster with a sheet gap smaller than the sheet gap g2.

Next, a description is given of the image forming apparatus 100 according to the present embodiment of this disclosure.

In the commercial printing industry, a system of variable data printing of a small lot of a wide variety of products is in a period of transition from a conventional offset printing machine to a Print On Demand (POD) using an electrophotographic image forming apparatus. In order to respond to these demands, recent electrophotographic image forming apparatuses are getting more and more expected to include registering accuracy of image positions on both sides corresponding to an offset printing machine (accuracy in positions of images formed on the first side and the second side of a recording sheet) and uniformity in images on both sides.

Factors of misregistration of image positions on both sides of a recording sheet, i.e., positional shift of an image formed on the first side of a recording sheet and an image formed on the second side of the recording sheet can be roughly categorized into registration errors of a recording sheet in the longitudinal and lateral directions, skew errors between a recording sheet and an image, and magnification errors due to variation (extension and shrinking) in length of an image when the toner image is transferred onto a recording sheet. Further, the registration errors, the skew errors, and the magnification errors of the factors of the misregistration of image positions on both sides of the recording sheet are different from each other in degree of error depending on types of recording sheets.

A comparative image forming apparatus adjusts an image to be formed on the second side of a recording sheet based on an image formed on the first side of the recording sheet by aligning an image writing time onto a surface of a photoconductor to a position of the image on the first side or by correcting a magnification of the image to be formed on the second side of the recording sheet to match the size of the image on the first side of the recording sheet. Specifically, in the comparative image forming apparatus, an image is formed together with a detection mark on the first side of a recording sheet. A change in magnification to image data of the image formed on the first side and a position of the image on the first side are obtained based on the detection mark on the first side of the recording sheet. Based on the detected position of the image, an image forming time is corrected so that an image to be formed on a second side of the recording sheet is aligned with the position of the image formed on the first side of the recording sheet. In addition, based on the detected change in magnification, a magnification of image data to be formed on the second side of the recording sheet is corrected so that a size of the image to be formed on the second side is matched with a size of the image formed on the first side. Consequently, image formation is started at the corrected image forming time. At the same time, based on the image data with the corrected magnification, an image is formed on the second side of the recording sheet conveyed again to an image forming position via a sheet reversing passage. Accordingly, the position and size of the image formed on the first side of the recording sheet are matched with the position and size of the image formed on the second side of the recording sheet.

However, even if the image on the first side of the recording sheet is corrected as described above, the accuracy corresponding to printing using a plate such as stencil (equal to or smaller than 0.3 mm) cannot be obtained.

For example, a recording sheet that is contracted by heat in the fixing device recovers to the original size as time elapses. In the above-described comparative image forming apparatus, the image on the first side of the recording sheet is detected at a position upstream from a transfer position in the sheet conveying direction, so that the magnification error with respect to the image data is obtained. However, even in a period of time from detection of the image on the first side to shift of the recording sheet to the transfer position, the recording sheet that is contracted keeps recovering. Therefore, the degree of variability of an image at the transfer position is likely to be different from the degree of variability of an image detecting the image. As a result, even if the magnification of the image on the second side of the recording sheet is corrected based on image data of the image formed on the first side of the recording sheet, it is likely that the size of the image on the first side is different from the size of the image on the second side. Accordingly, the magnification cannot be corrected with high precision.

Further, due to a cutting error in a bundle of recording sheets, one end of a recording sheet that is a leading end in the sheet conveying direction when forming an image on the first side of the recording sheet and an opposite end of the recording sheet that is a trailing end in the sheet conveying direction when forming an image on the first side of the recording sheet are likely to incline to the sheet conveying direction. When forming an image on the second side of a recording sheet, the recording sheet is switched back, reversed, and conveyed to the secondary transfer nip region again. Therefore, the opposite end that is the trailing end of the recording sheet in the sheet conveying direction when forming an image on the first side of the recording sheet becomes the leading end of the recording sheet in the sheet conveying direction when forming an image on the second side of the recording sheet.

Before conveying the recording sheet to the secondary transfer nip region, the leading end of the recording sheet comes to contact the pair of registration rollers 34. In a case in which there is a cutting error in a bundle of recording sheets, a position of a recording sheet when the one end (the leading end) in the sheet conveying direction contacts the pair of registration rollers 34 for image formation on the first side of the recording sheet becomes different from a position of the recording sheet when the opposite end (the trailing end) in the sheet conveying direction contacts the pair of registration rollers 34 for image formation on the second side of the recording sheet. As a result, a transfer position of the recording sheet when transferring the image onto the first side of the recording sheet and a transfer position of the recording sheet when transferring the image on the second side of the recording sheet are different from each other. Consequently, even if the position of the image to be formed on the second side of the recording sheet is corrected based on the image formed on the first side of the recording sheet, the position of the image on the second side of the recording sheet shifts from the position of the image on the first side of the recording sheet.

In order to avoid this positional shift, in electrophotographic image forming apparatuses for conventional commercial printing, images are formed on both sides of a graph paper or a recording sheet on which squares are previously printed such as a graph paper. Then, the position of the image is measured manually. The result of measurement is inputted to an electrophotographic image forming apparatus. Based on the inputted measurement result, the image is positioned and the magnification is corrected manually. However, manual measurement and manual input take a large amount of manpower and time. Further, it is likely that human errors such as measurement errors and input errors hinder achievement to required accuracy.

In order to address the above-described inconvenience, the image forming apparatus 100 according to the present embodiment of this disclosure can obtain precision equal to the level of printing using stencil. At the same time, the image forming apparatus 100 according to the present embodiment of this disclosure includes a process that is automated from measurement to correction of shift amount of a recording sheet so as to reduce a load applied to users.

A detailed description is given of the operations performed in the image forming apparatus 100 according to the present embodiment of this disclosure.

Figure 3:
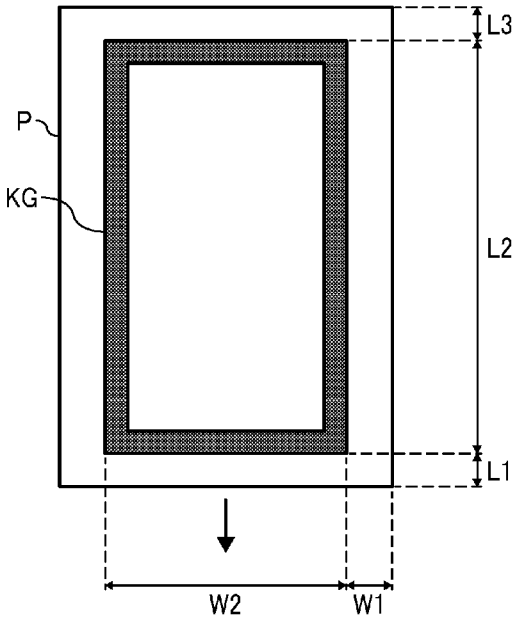
FIG. 3 is a diagram illustrating a recording sheet on which an image for detection is formed and measurement portions.

In the present embodiment, a detection image KG including a frame line is formed as a dedicated pattern image on both sides of the recording sheet P, as illustrated in FIG. 3. Then, as illustrated in FIG. 1, the position detecting device 10 disposed between the pair of registration rollers 34 and the secondary transfer roller 72 measures a leading end margin length L1, an image length L2, and a trailing end margin length L3. The leading end margin length L1 indicates a length from the leading end of the recording sheet in the sheet conveying direction to the leading end of the detection image KG in the sheet conveying direction. The image length L2 indicates a length of the detection image KG in the sheet conveying direction. The trailing end margin length L3 indicates a length from the trailing end of the detection image KG in the sheet conveying direction to the trailing end of the recording sheet P in the sheet conveying direction. The position detecting device 10 also measures a width margin length W1 and an image width W2. The width margin length W1 indicates a length from one end of the recording sheet P in a sheet width direction to one end of the detection image KG in the sheet width direction. The image width W2 indicates a width of the detection image KG. The position detecting device 10 measures the lengths L1 through L3 and the widths W1 and W2 on both the first and second sides of the recording sheet P and grasps the positional shift amounts and magnification errors of the images on the recording sheet P. Consequently, the image forming position is corrected based on the obtained positional shift amounts and the magnification of the images based on the obtained magnification errors.

In order to prevent paper jam caused by a recording sheet winding around a fixing member and contamination of an image forming apparatus due to transfer of part of a toner image onto an area in which no sheet is set, an image masking area is provided so as to avoid image formation to the edge of a recording sheet. A larger reference image is more preferable because the greater the size of a reference image is, the more the effect of measurement error of a sensor is reduced when calculating the image length L2 and the image width W2. Therefore, a reference image of a frame line preferably has the greatest size within a range where the reference image does not overlap the image masking area. Accordingly, the detection image KG has the largest applicable size to the recording sheet P in the design of the image forming apparatus 100 and the image length L2 and the image width W2 can be calculated precisely.

Further, the image masking area can be narrower when the reference image is formed.

The detection image KG is formed in a single color from yellow, magenta, cyan, and black, for example, with a large contrast difference from the color of the recording sheet P. It is preferable to form the detection image KG in a single color. In the present embodiment, the detection image KG is formed in black having a large contrast difference from the color of white of the recording sheet P.

It is to be noted that the shape and color of the detection image KG is not limited to the examples described above but is applicable to any other shapes and colors.

Figure 4:
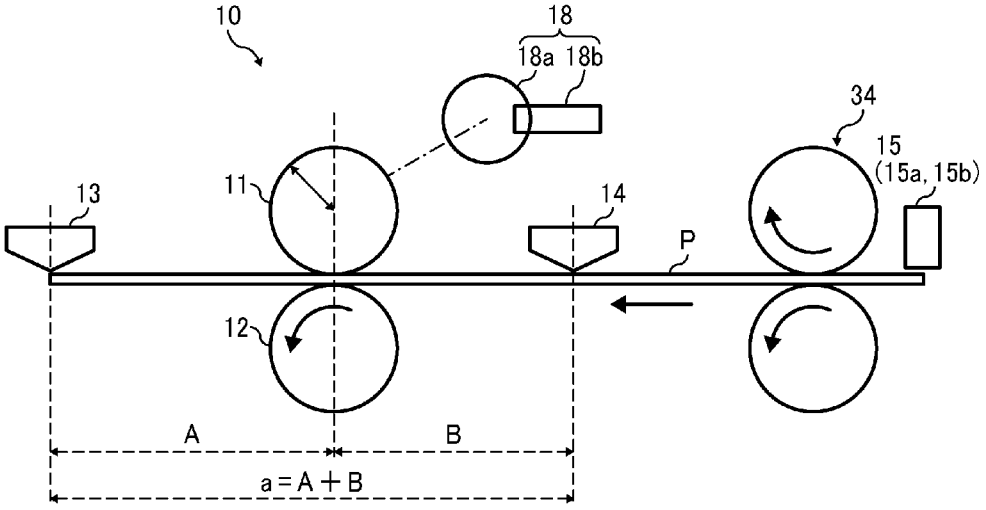
FIG. 4 is a schematic cross sectional view illustrating a position detecting device.
Figure 5:
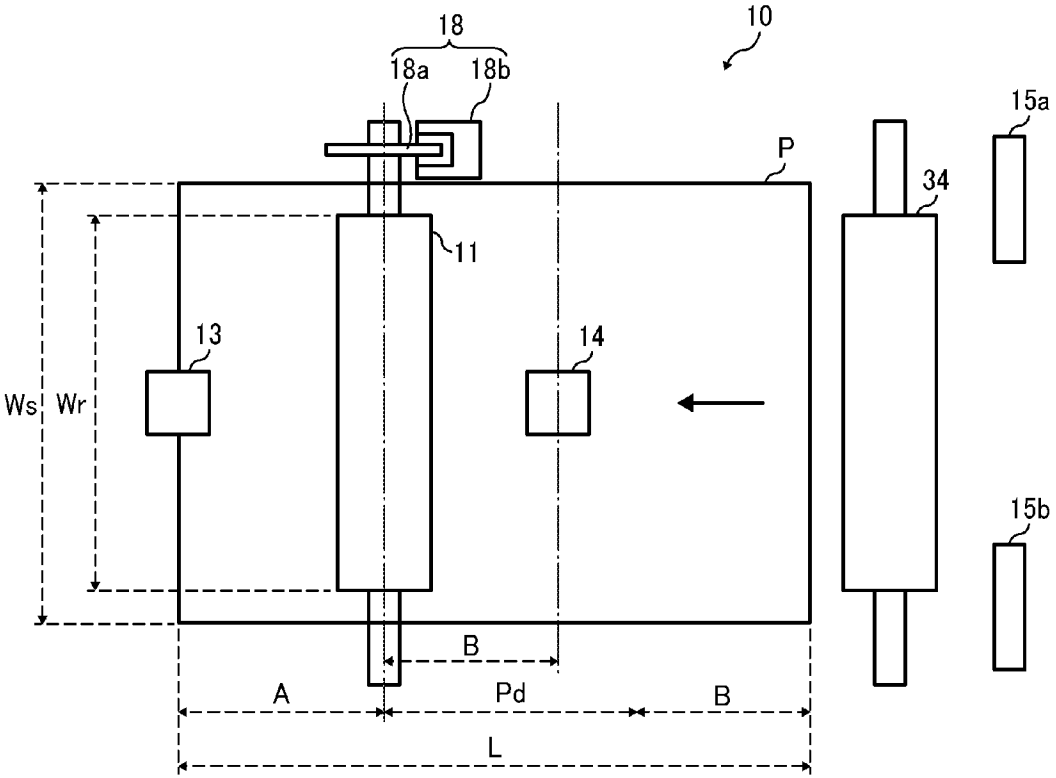
FIG. 5 is a schematic plan view illustrating the position detecting device.

FIG. 4 is a schematic cross sectional view illustrating the position detecting device 10 that functions as a position detector. FIG. 5 is a schematic plan view illustrating the position detecting device 10.

The position detecting device 10 includes a drive roller 12 and a driven roller 11. The drive roller 12 rotates in response to a driving force applied by a drive source such as a motor. The driven roller 11 is rotated with the drive roller 12 while holding the recording sheet P with the drive roller 12.

As illustrated in FIG. 5, the driven roller 11 has a length Wr in an axial direction. The length Wr of the driven roller 11 extends in the width direction of the recording sheet P that is perpendicular to the sheet conveying direction of the recording sheet P. In addition, a minimum width Ws of the recording sheet P is a smallest width of the recording sheet P the image forming apparatus 100 can convey. The length Wr of the driven roller 11 is set smaller than the minimum width Ws of the recording sheet P, as illustrated in FIG. 5. Accordingly, the driven roller 11 does not contact the drive roller 12 during conveyance of the recording sheet P, and therefore the driven roller 11 is rotated by a friction force generated between the driven roller 11 and the recording sheet P.

A rotary encoder 18 is mounted on one end in an axial direction of the driven roller 11 of the position detecting device 10. The rotary encoder 18 is fixedly mounted on a rotary shaft of the driven roller 11. The rotary encoder 18 includes an encoder disk 18*a* and an encoder sensor 18*b*. The encoder disk 18*a* rotates together with the driven roller 11 as a single unit. The encoder sensor 18*b* detects a slit on the encoder disk 18*a*.

As described above, the present embodiment includes the rotary encoder 18 on the rotary shaft of the driven roller 11 of the position detecting device 10. However, the rotary encoder 18 may be alternatively mounted on a rotary shaft of the drive roller 12.

Further, as the diameter of a roller on which the rotary encoder 18 is mounted becomes smaller, the number of rotations of the roller along with sheet conveyance increases, and therefore the quantity of pulses to count increases. Accordingly, it is preferable to measure a distance of conveyance of the recording sheet P with high precision.

Further, the driven roller 11 and the drive roller 12 are preferably metallic rollers to secure an axial runout accuracy for mounting the rotary encoder 18 on either of the driven roller 11 and the drive roller 12. By restraining the runout of the rotary shaft of a selected one of the driven roller 11 and the drive roller 12, the leading end margin length L1, the image length L2, and the trailing end margin length L3 can be measured with high precision.

The drive roller 12 rotates in a direction indicated by arrow in FIG. 4. When not conveying any recording sheet P (when idling), the driven roller 11 is rotated with the drive roller 12. By contrast, when conveying a recording sheet P, the driven roller 11 is rotated with the recording sheet P. As the driven roller 11 is rotated, a pulse is generated by the rotary encoder 18 mounted on the rotary shaft of the driven roller 11.

A pulse measuring device 21 (see FIG. 6) is connected to the rotary encoder 18. The pulse measuring device 21 measures the number of pulses from the rotary encoder 18.

A stop trigger sensor 14 is disposed upstream from the drive roller 12 and the driven roller 11 in the sheet conveying direction of the recording sheet P. A start trigger sensor 13 is disposed downstream from the drive roller 12 and the driven roller 11 in the sheet conveying direction of the recording sheet P. The start trigger sensor 13 detects passage of an end of the recording sheet P in the sheet conveying direction. The stop trigger sensor 14 also detects passage of the end of the recording sheet P in the sheet conveying direction. Both the start trigger sensor 13 and the stop trigger sensor 14 also detect passage of the end of an image on the recording sheet P in the sheet conveying direction. Both the start trigger sensor 13 and the stop trigger sensor 14 according to the present embodiment include reflection type optical sensors. However, the configurations of the start trigger sensor 13 and the stop trigger sensor 14 are not limited thereto. For example, any transmission type optical sensor or any reflection type optical sensor having high detection precision at the end of the recording sheet P can be applied to this disclosure.

The start trigger sensor 13 that is disposed downstream from the driven roller 11 and the drive roller 12 in the sheet conveying direction detects passage of the leading end of the recording sheet P in the sheet conveying direction and passage of the leading end of the image on the recording sheet P in the sheet conveying direction. The stop trigger sensor 14 that is disposed upstream from the driven roller 11 and the drive roller 12 in the sheet conveying direction detects passage of the trailing end of the recording sheet P in the sheet conveying direction and passage of the trailing end of the image on the recording sheet P in the sheet conveying direction.

In the present embodiment, the start trigger sensor 13, the stop trigger sensor 14, and the rotary encoder 18 measure the leading end margin length L1, the image length L2, and the trailing end margin length L3 illustrated in FIG. 3.

As illustrated in FIG. 5, the start trigger sensor 13 and the stop trigger sensor 14 are disposed at substantially same positions in the width direction perpendicular to the sheet conveying direction of the recording sheet P. By arranging the start trigger sensor 13 and the stop trigger sensor 14 as described above, an effect to a position of conveyance of the recording sheet P (skew to the sheet conveying direction) is relatively reduced, so that the distance of conveyance of the recording sheet P can be measured more precisely. Accordingly, the leading end margin length L1, the image length L2, and the trailing end margin length L3 can be measured.

As described above, the start trigger sensor 13 and the stop trigger sensor 14 are arranged at a center in the width direction perpendicular to the sheet conveying direction of the recording sheet Pin the configuration of the present embodiment. However, the arrangement in position of the start trigger sensor 13 and the stop trigger sensor 14 are not limited thereto. For example, as long as the start trigger sensor 13 and the stop trigger sensor 14 are disposed within an area in which the recording sheet P passes, the positions of the start trigger sensor 13 and the stop trigger sensor 14 may be shifted from the center to either end in the width direction of the recording sheet P.

The position detecting device 10 further includes a line sensor such as a contact image sensor (CIS). The line sensor 15 is disposed upstream from the pair of registration rollers 34 in the sheet conveying direction of the recording sheet P. As illustrated in FIG. 4, the line sensor 15 includes two line sensors 15*a* and 15*b*. The line sensor 15*a* detects one end in the width direction of the image on the recording sheet P and the line sensor 15*b* detects an opposite end in the width direction of the image on the recording sheet P. The line sensors 15*a* and 15*b* of the line sensor 15 measure the width margin length W1 and the image width W2 illustrated in FIG. 3.

The line sensor 15 is preferably disposed within a constant distance with an opposed unit or component. In a case in which the recording sheet P significantly flaps while being conveyed, it is likely that the line sensor 15 degrades the precision in detection of the recording sheet P. In order to prevent or restrain flapping of the recording sheet P, components to adjust respective positions of conveyance of the recording sheet P at both upstream and downstream sides from the line sensor 15 in the sheet conveying direction.

A distance A illustrated in FIGS. 4 and 5 is a distance between the start trigger sensor 13 in the sheet conveying passage of the recording sheet P and a line connecting a center of rotation of the drive roller 12 and a center of rotation of the driven roller 11. A distance B illustrated in FIGS. 4 and 5 is a distance between the stop trigger sensor 14 and a line connecting the center of rotation of the drive roller 12 and the center of rotation of the driven roller 11. It is preferable that a pulse count area is increased by reducing the distance A and the distance B.

A sheet conveyance distance Pd of the recording sheet P from a time ta to a time t6 is obtained by the following equation (1).

$$Pd=(n/N)*2\pi r \quad (1),$$

where "r" represents a radius of the driven roller 11 on which the rotary encoder 18 is mounted [mm], "N" represents the number of pulses of the rotary encoder 18 per rotation of the driven roller 11 [/r], and "n" represents the number of pulses counted during a pulse count time "Pt".

The conveying speed of a recording sheet P generally changes depending on mechanical accuracy such as external shape accuracy of rollers (especially, the drive roller 12) that conveys the recording sheet P, the runout accuracy (axial deflection) of the rollers, the rotational accuracy of, for example, a motor, and accuracy in a power transmission mechanism including gears and belts. The conveying speed of the recording sheet P also changes depending on slippage between the drive roller 12 and the recording sheet P and slack of the recording sheet P due to difference between an upstream side conveying speed and a downstream side conveying speed of a conveyance body. Therefore, while a pulse period and a pulse width of the rotary encoder 18 change constantly, the number of pulses of the rotary encoder 18 does not change.

It is to be noted that a length L of the recording sheet P in the sheet conveying direction can be obtained by adding a distance "a" from the position of the stop trigger sensor 14 to the position of the start, trigger sensor 13 (a=A+B) as illustrated in FIG. 4 to the sheet conveyance distance Pd of the recording sheet during the pulse counting period Pt (from the time ta to the time t6) obtained by the equation (1).

The length L of the recording sheet P in the sheet conveying direction is obtained by the following equation (2).

$$L=(n/N)*2\pi r+a \quad (2),$$

where "a" represents a distance from the position of the start trigger sensor 13 to the position of the stop trigger sensor 14.

Accordingly, the controller 20 can obtain the length L of the recording sheet P in the sheet conveying direction by the equation (2) in which the distance "a" from the position of the stop trigger sensor 14 to the position of the start trigger sensor 13 is added to the sheet conveyance distance Pd of the recording sheet P during the pulse counting period Pt obtained by the equation (1).

Figure 6:
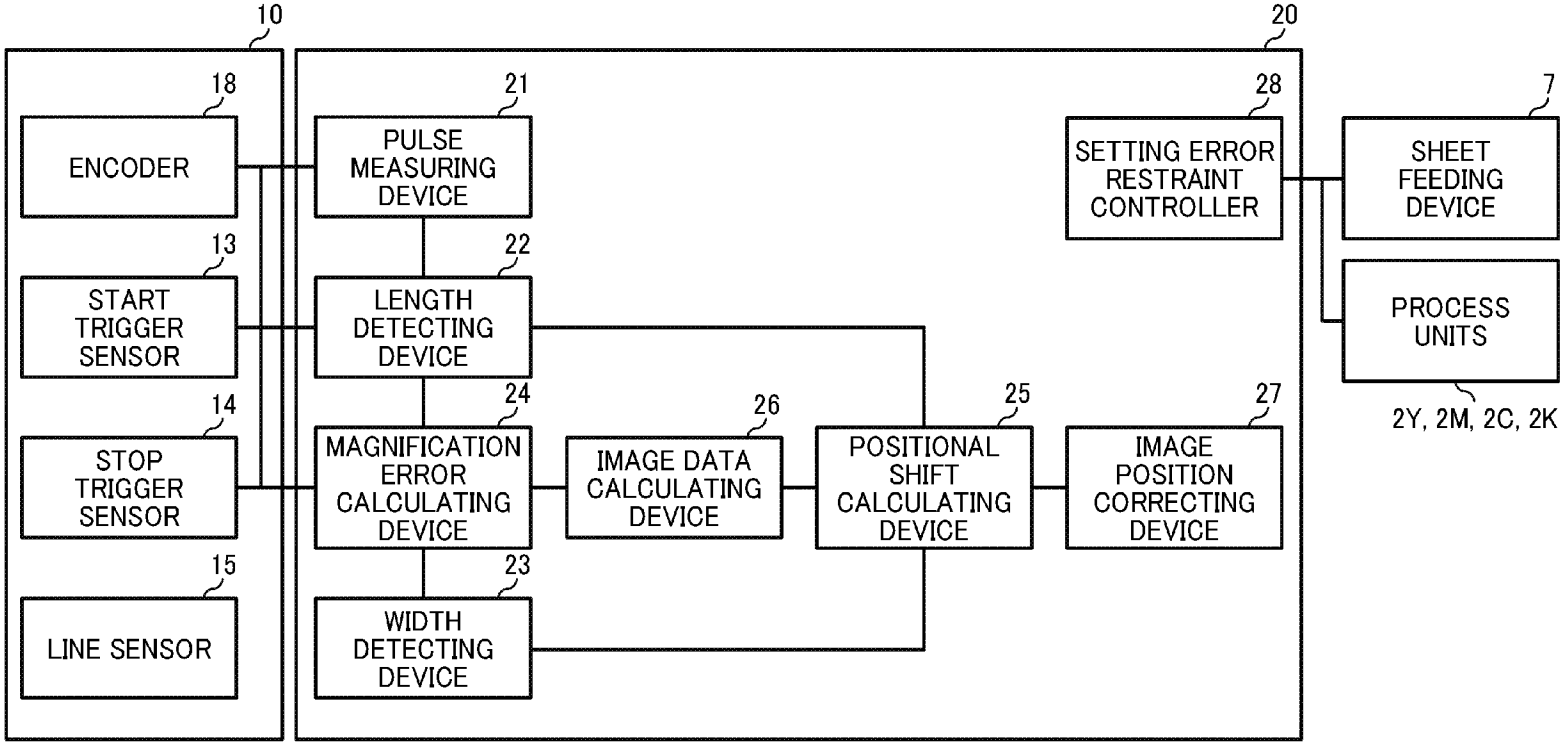
FIG. 6 is a block diagram illustrating part of an electric circuit of the image forming apparatus.

FIG. 6 is a block diagram illustrating part of an electric circuit of the image forming apparatus 100 according to the present embodiment of this disclosure.

The controller 20 includes a central processing unit (CPU), a random access memory (RAM), a read only memory (ROM), and a nonvolatile memory. The controller 20 reads out programs stored in the ROM that functions as a storage medium to control driving of various units and components in the image forming apparatus 100 and performs various calculations.

The controller 20 includes the pulse measuring device 21 to measure the number of pulses output from the rotary encoder 18.

The controller 20 further includes a length detecting device 22 and a width detecting device 23.

The length detecting device 22 measures the leading end margin length L1, the image length L2, and the trailing end margin length L3 based on measurement results by the pulse measuring device 21 and detection results by the start trigger sensor 13 and the stop trigger sensor 14.

The width detecting device 23 measures the width margin length W1 and the image width W2 based on detection results by the line sensor 15 such as a CIS.

The controller 20 also includes a magnification error calculating device 24 and an image data correcting device 26.

The magnification error calculating device 24 calculates magnification errors based on image position information that is obtained by the detection image KG formed on the first side and the second side of the recording sheet P. The image position information includes the leading end margin length L1, the image length L2, the trailing end margin length L3, the width margin length W1, and the image width W2.

The image data correcting device 26 corrects image data based on magnification errors calculated by the magnification error calculating device 24.

The controller 20 further includes a positional shift calculating device 25 and an image position correcting device 27. The positional shift calculating device 25 calculates positional shift amounts based on the image position information that is obtained by the detection image KG formed on both the first side and the second side of the recording sheet P. The image position correcting device 27 corrects an image position based on the positional shift amount calculated by the positional shift calculating device 25.

The magnification error calculating device 24 may calculate the magnification error of the detection image KG formed on one of the first side and the second side of the recording sheet P to the other of the first side and the second side of the recording sheet P. Alternatively, the magnification error calculating device 24 may calculate magnification errors of the images on both sides of the recording sheet P relative to an ideal reference image. The image data correcting device 26 corrects the magnification of image data by thinning out the pixels of the image data with a predetermined algorithm based on difference in magnification errors calculated by the magnification error calculating device 24.

Further, the positional shift calculating device 25 may calculate a positional shift amount of the detection image KG formed on one of the first side and the second side of the recording sheet P to the other of the first side and the second side of the recording sheet P. Alternatively, the magnification error calculating device 24 may calculate positional shift amounts of the images on both sides of the recording sheet P relative to a desired reference image. The image position correcting device 27 corrects the position of an image to be formed on the recording sheet P by calibrating writing timings of the optical writing device 1 based on the positional shift amount calculated by the positional shift calculating device 25.

The controller 20 further includes a setting error prevention controller 28 that functions as a sheet setting detector to detect whether the recording sheet is loaded on any of the first sheet container 101 and the second sheet container 102 by detecting opening and closing the selected one of the first sheet container 101 and the second sheet container 102.

Further, the setting error prevention controller 28 includes a guide to instruct the process units 2Y, 2M, 2C, and 2K to form an image to indicate information of either one of the first sheet container 101 and the second sheet container 102 (e.g., the first sheet container 101 in FIGS. 7A and 7B), the sheet conveying direction, and a user-side direction and an image for the user to inform that the recording sheet is to be reversed before setting to the selected one of the first sheet container 101 and the second sheet container 102.

Further, the setting error prevention controller 28 is configured to lock sheet trays other than the specified sheet tray to load the detection recording sheet thereon.

The pulse measuring device 21, the length detecting device 22, the width detecting device 23, the magnification error calculating device 24, the positional shift calculating device 25, the image data correcting device 26, and the image position correcting device 27 included in the controller 20 are executed by the programs stored in the ROM that functions as a storage medium.

Figure 7A:
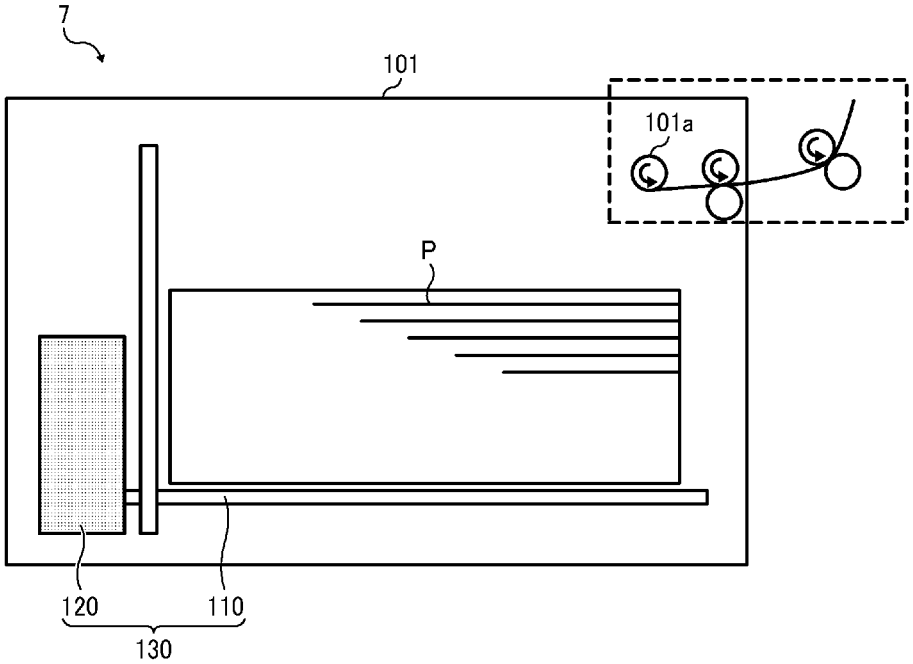
FIG. 7A is a side view illustrating a sheet container located at a sheet retreating position.
Figure 7B:
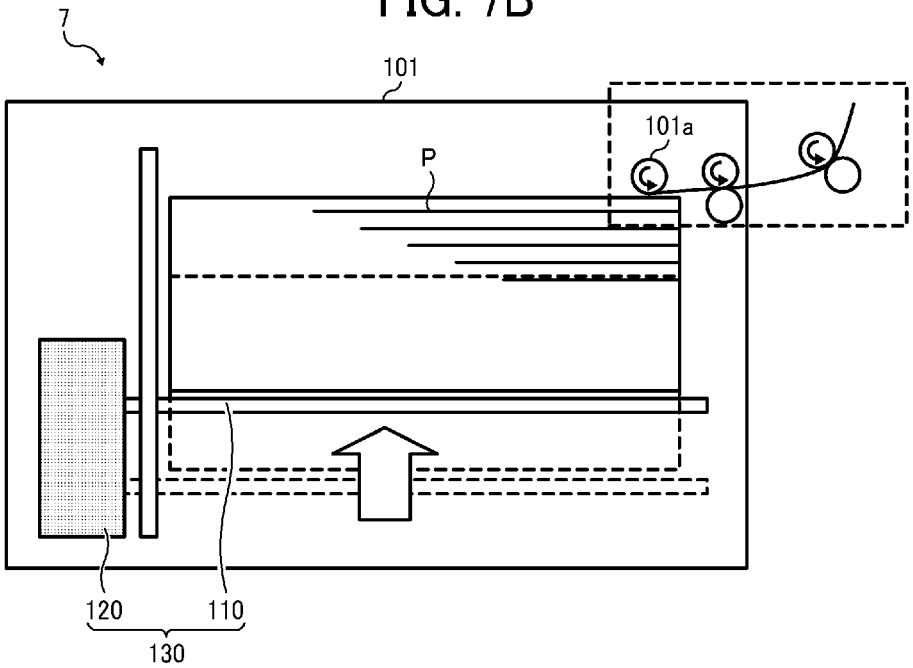
FIG. 7B is a side view illustrating the sheet container located at a sheet feeding position.

FIG. 7A is a side view illustrating the first sheet container 101 at a sheet retreating position and FIG. 7B is a side view illustrating the first sheet container 101 at a sheet feeding position at which the recording sheet contacts the first sheet feed roller 101*a* to be fed forward. The sheet retreating position is a position at which the recording sheet is separated from the sheet feeding position and away from the sheet feed roller 101*a*.

It is to be noted that, even though FIGS. 7A and 7B illustrate the first sheet container 101 and the first sheet feed roller 101*a*, this configuration can also be applied to the second sheet container 102 and the second sheet feed roller 102*a*.

In FIGS. 7A and 7B, the recording sheets in the first sheet container 101 are loaded on a bottom plate 110. The bottom plate 110 moves vertically as a bottom plate driving device 120 drives. The bottom plate 110 and the bottom plate driving device 120 form a sheet moving device 130 to move the recording sheets between the sheet feeding position and the sheet retreating position.

Figure 8:
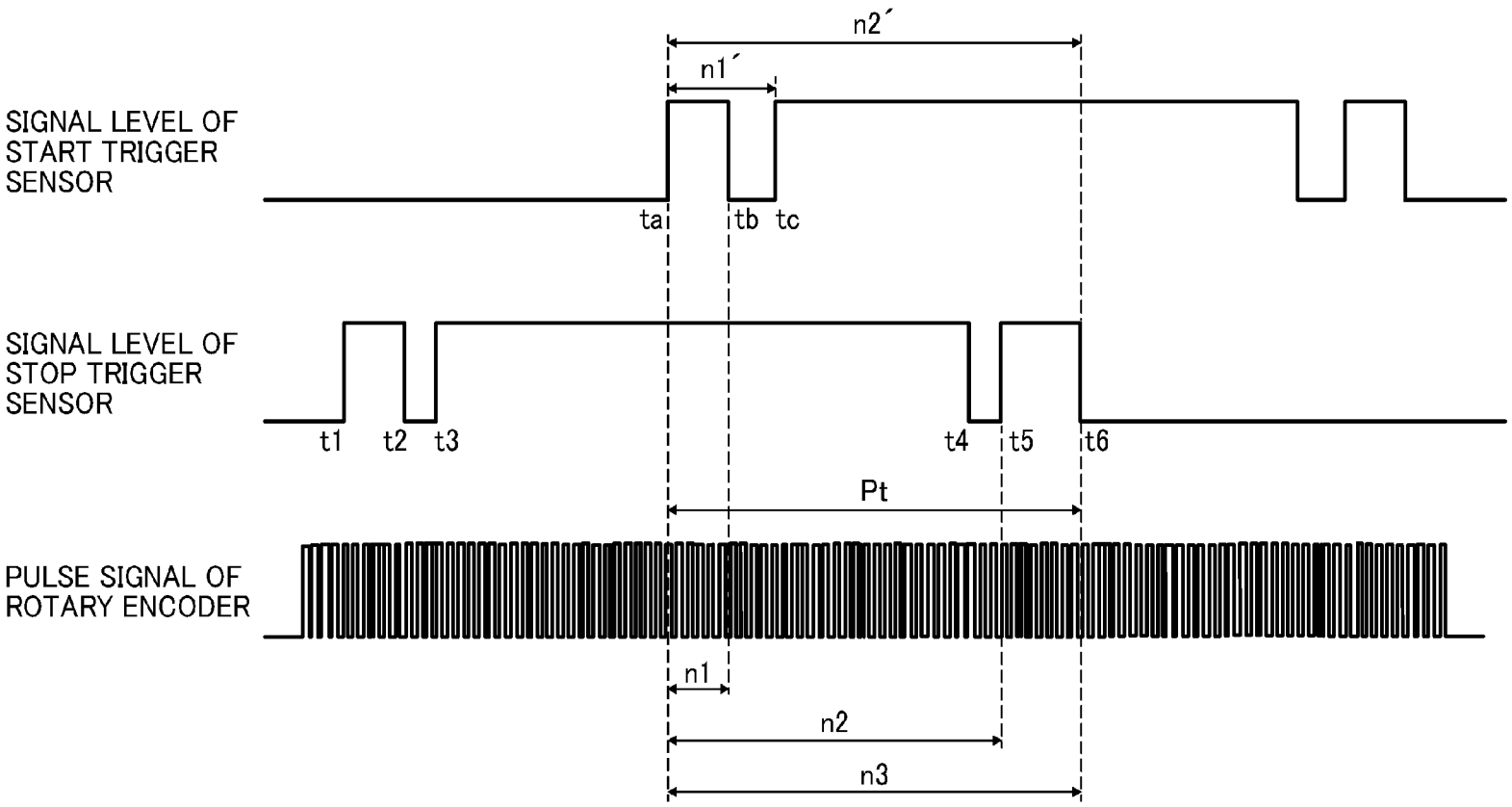
FIG. 8 is a diagram illustrating respective outputs of a start trigger sensor, a stop trigger sensor, and a rotary encoder.

FIG. 8 is a diagram illustrating respective outputs of the start trigger sensor 13, the stop trigger sensor 14, and the rotary encoder 18.

As conveyance the recording sheet P starts, the driven roller 11 is rotated, and a pulse signal is generated by the rotary encoder 18.

At a time to from the start of conveyance of the recording sheet P, the start trigger sensor 13 detects passage of the leading end of the recording sheet P in the sheet conveying direction. At this moment, the pulse measuring device 21 of the controller 20 starts measuring the number of pulses output from the rotary encoder 18.

At a time tb, the start trigger sensor 13 detects passage of the leading end of the detection image KG in the sheet conveying direction. At this moment, the length detecting device 22 of the controller 20 stores the number of pulses n1 in a memory.

Then, at a time t5, the stop trigger sensor 14 detects passage of the trailing end of the detection image KG in the sheet conveying direction. At this moment, the length detecting device 22 stores the number of pulses n2 in the memory.

At a time t6, the stop trigger sensor 14 detects passage of the recording sheet P in the sheet conveying direction. At this moment, the length detecting device 22 stores the number of pulses n3 in the memory and the pulse measuring device 21 completes the measurement of pulses from the rotary encoder 18.

It is to be noted that the number of pulses n3 corresponds to the pulse count time Pt.

The leading end margin length L1 is obtained by the following equation (3).

$$L1=(n1/N)*2\pi r \quad (3),$$

where "r" represents a radius of the driven roller 11 on which the encoder disk 18*a* is mounted and "N" represents the number of pulses of the rotary encoder 18 per rotation of the driven roller 11.

The trailing end margin length L3 is obtained by the following equation (4).

$$L3=\{(n3-n2)/N\}*2\pi r \quad (4).$$

The image length L2 is obtained by the following equation (5).

$$L2=\{(n2-n1)/N\}*2\pi r+a \quad (5),$$

where "a" represents a distance from the position of the stop trigger sensor 14 to the position of the start trigger sensor 13 (a=A+B).

Further, the center of the frame line extending in the width direction of the detection image KG can be the end of an image. Specifically, the controller 20 stores the number of pulses n1 at the time tb at which the start trigger sensor 13 detected arrival of the frame line extending in the width direction at the leading end of the detection image KG and the number of pulses n1' at a time tc at which the start trigger sensor 13 detected passage of the frame line at the leading end of the detection image KG. The controller 20 calculates a mean value of the number of pulses n1 at the time ta and the number of pulses n1' at the time tb. The mean value is determined as the number of pulses obtained when the center of the frame line extending in the width direction reached the start trigger sensor 13.

Further, the number of pulses is regarded as the number of pulses obtained when the leading end of the detection image KG passed by the start trigger sensor 13. The leading end margin length L1 is calculated based on the number of pulses. Similar to the leading end of the detection image KG, the controller 20 stores the number of pulses n2' at a time t4 at which the stop trigger sensor 14 detected arrival of the frame line extending in the width direction at the trailing end of the detection image KG and the number of pulses n2 at the time t5 at which the stop trigger sensor 14 detected passage of the frame line at the trailing end of the detection image KG. Then, the controller 20 calculates a mean value of the number of pulses n2' at the time t4 and the number of pulses n2 at the time t5. The mean value is determined as the number of pulses obtained when the trailing end of the detection image KG in the sheet conveying direction passed by the stop trigger sensor 14.

By considering the center of the frame line extending in the width direction of the detection image KG as the end of the image, dispersion of sensor output values due to variation in components of the start trigger sensor 13 and the stop trigger sensor 14 and effects of the threshold of the sensor output values set to determine passage of the recording sheet P and passage of the image can be reduced. Accordingly, the measurement accuracy of the position of the end of the image can be preferably enhanced.

The conveying speed of a recording sheet P generally changes depending on the external shape accuracy of a roller (especially, a drive roller) that conveys the recording sheet P, the runout accuracy, the rotational accuracy in, for example, a motor, and the precision in a power transmission mechanism including gears and belts. The conveying speed of the recording sheet P also changes depending on slippage between a drive roller and the recording sheet P, and slack of the recording sheet P due to difference between an upstream side conveying speed and a downstream side conveying speed of a conveyance body. Accordingly, when the leading end margin length L1 is calculated based on the time from detection of the leading end of the recording sheet P in the sheet conveying direction to detection of the leading end of the detection image KG, the result includes a large number of measurement errors due to variation of the conveying speed.

By contrast, while a pulse period and a pulse width of the rotary encoder 18 change the pulse signal output timings depending on the variation of the conveying speed, the number of pulses does not change. Accordingly, by measuring based on the number of pulses of the rotary encoder 18, the leading end margin length L1, the image length L2, and the trailing end margin length L3 can be measured with precision without being affected by the conveying speed of the recording sheet P.

Next, a description is given of detection of the width margin length W1 and the image width W2 of the detection image KG by the width detecting device 23.

The line sensor 15 includes multiple light receiving elements aligned in the width direction and a light emitting element such as a light emitting diode (LED) When the multiple light receiving elements are disposed facing the recording sheet P, each of the multiple light receiving elements receives reflected light that is reflected from the recording sheet P to output a predetermined voltage value.

By contrast, when the multiple light receiving elements are not disposed facing the recording sheet P but facing the detection image KG, reflected light hardly enters each of the multiple light receiving elements, and therefore the predetermined voltage value is not output.

When detecting the end in the width direction of the recording sheet P, the width detecting device 23 checks which light receiving element from the most outside end in the width direction of the line sensor 15 outputs the predetermined voltage value, in other words, indicates existence of the recording sheet P. Consequently, the width detecting device 23 determines the position of a first one of the light receiving elements that output the predetermined voltage value as the end in the width direction of the recording sheet P.

Further, the width detecting device 23 checks which light receiving element from the most outside end in the width direction of the recording sheet P does not output the predetermined voltage value, in other words, indicates absence of the recording sheet P. Then, the width detecting device 23 obtains the position of a first one of the light receiving elements that do not output the predetermined voltage value as the end in the width direction of the detection image KG. Consequently, the width detecting device 23 measures the width margin length W1 based on the position of the end in the width direction of the recording sheet P and the position of the end in the width direction of the detection image KG.

Further, the width detecting device 23 measures the image width W2 of the detection image KG based on the position of the end in the width direction of the detection image KG detected by the line sensor 15*a* and the position of the end in the width direction of the detection image KG detected by the line sensor 15*b*.

Further, the center of the frame line extending in the sheet conveying direction of the detection image KG can be the end in the width direction of the detection image KG. Accordingly, variation in outputs of the light receiving elements does not adversely affect measurement results. Therefore, it is preferable to perform the detection as described above.

Next, a description is given of adjustment of misregistration of image positions on both sides of a recording sheet P.

The adjustment of misregistration of image positions on both sides of the recording sheet P is performed by reading a program stored in the storage medium of the controller 20.

Figure 9:
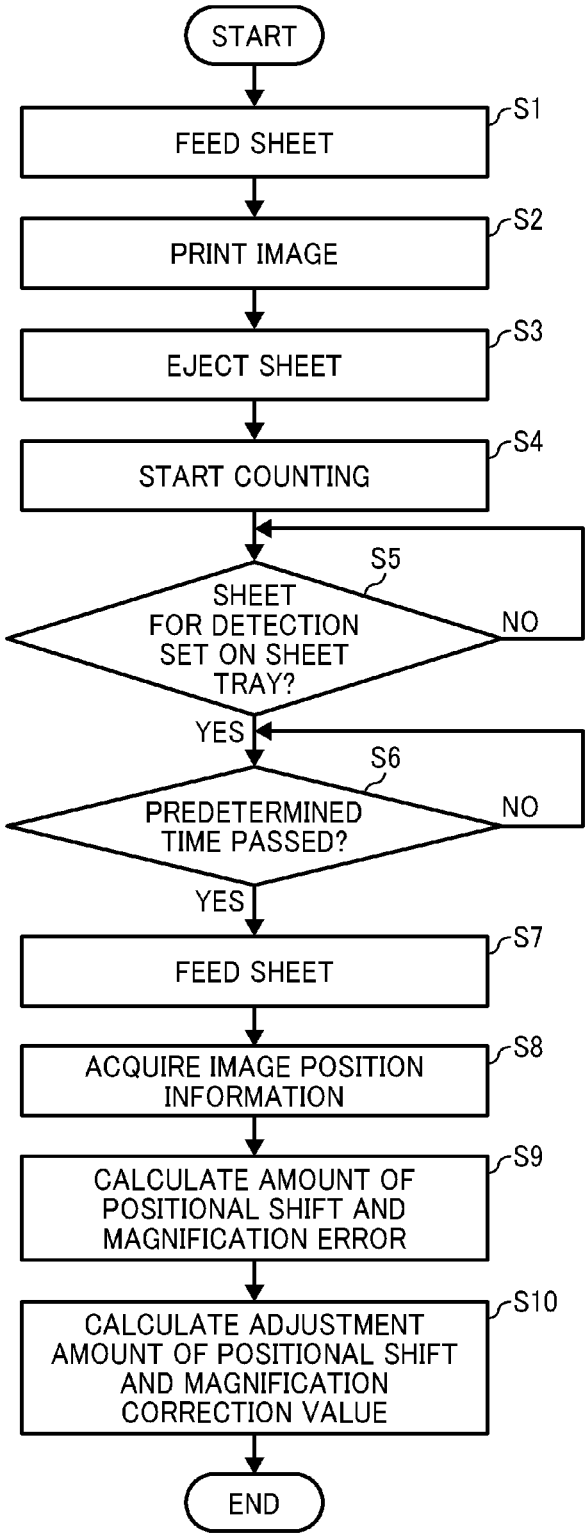
FIG. 9 is a flowchart of control in a misregistration correction mode.

FIG. 9 is a flowchart of control in an adjustment mode of image shift on both sides of a recording sheet.

A user operates a control panel 8 (see FIG. 1) of the image forming apparatus 100 to send instruction to perform an adjustment mode of image shift on both sides of a recording sheet in which image shifts of an image on the first side of the recording sheet and an image on the second side of the recording sheet are corrected. Consequently, the controller 20 causes the recording sheet P set in a predetermined sheet tray to be fed in step S1. Then, the detection image KG is formed on both sides of the recording medium P, in step S2. A larger sheet can accept a larger detection image KG, and therefore effects due to detection errors by sensors can be reduced. Accordingly, the recording sheet to be set in the sheet tray can be specified to a possible largest size of a recording sheet on which the image forming apparatus 100 can form an image, so that the specified sheet size can be used.

In the present embodiment, the detection image KG is printed on both sides of the recording sheet P in an alternate printing period under an interleaf control, as illustrated in FIG. 2.

In the duplex printing, it takes a long time from image formation on the first side of a recording sheet until image formation on the second side of the recording sheet. In addition, even in the above-described interleaf control, a gap between recording sheets in a first side consecutive printing period and a gap between recording sheets in a second side consecutive printing period are greater than a length of the recording sheet in the sheet conveying direction.

Figure 10A:
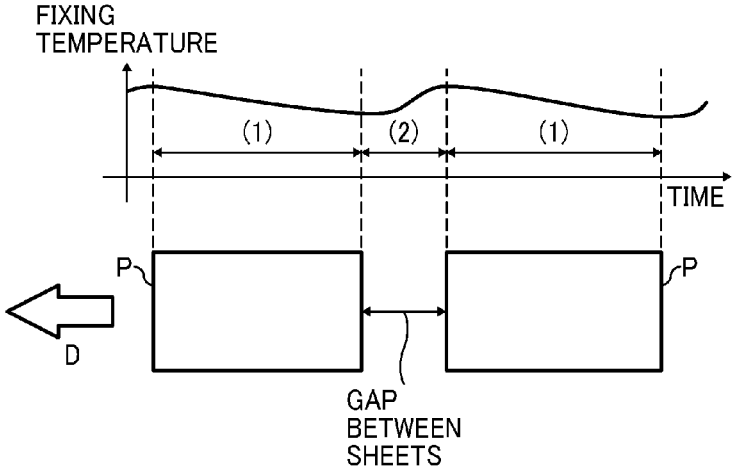
FIG. 10A is a diagram illustrating an example of changes in fixing temperature in an alternate printing period in an interleaf control.
Figure 10B:
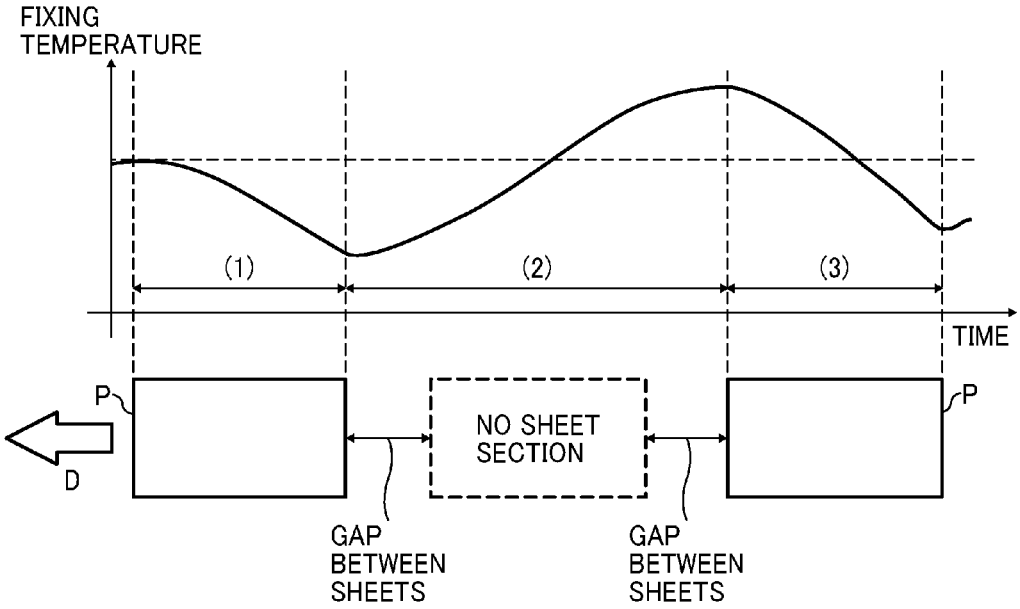
FIG. 10B is a diagram illustrating an example of changes in fixing temperature in a first side consecutive printing period in the interleaf control.

FIG. 10A is a diagram illustrating an example of changes in fixing temperature in the alternate printing period under the interleaf control. FIG. 10B is a diagram illustrating an example of changes in fixing temperature in the first side consecutive printing period under the interleaf control. It is to be noted that reference letter "D" in FIGS. 10A and 10B indicates the sheet conveying direction. Further, reference letter "D" is occasionally used as the sheet conveying direction in other drawings according to this disclosure.

While the recording sheet is passing in a fixing nip region, heat is conducted to the recording sheet, and therefore the fixing temperature drops. Then, the conducted heat is stored in the fixing unit in the gap between recording sheets, and therefore the fixing temperature increases.

As illustrated in FIG. 10A, the gap between recording sheets is smaller than the length of a recording sheet in the sheet conveying direction in the alternate printing period. Consequently, the fixing temperature does not increase significantly in the gap between recording sheets. Therefore, the fixing operation to a subsequent recording sheet is performed at a substantially same fixing temperature as a preceding recording sheet. As a result, there is a small variation in thermal contraction of the recording sheet due to moisture evaporation.

By contrast, as illustrated in FIG. 10B, the gap between recording sheets in the first side consecutive printing period is greater than the length of the recording sheet in the sheet conveying direction. Therefore, there is a large increase in fixing temperature in the gap between recording sheets. Accordingly, the quantity of heat to be conducted to the subsequent recording sheet is greater than the quantity of heat to the preceding recording sheet, and therefore the thermal contraction of the subsequent recording sheet is greater than the thermal contraction of the preceding recording sheet. Due to these reasons, the variation in thermal contraction of the recording sheets increases in the first side consecutive printing period.

Similar to the first side consecutive printing period, the gap between recording sheets in the second side consecutive printing period is also greater than the length of the recording sheet in the sheet conveying direction, and therefore the variation in thermal contraction of the recording sheets increases in the second side consecutive printing period.

Further, the commercial printing machines print a large amount of recording sheets in a duplex printing mode. Specifically, the commercial printing machines do not print a small number of recording sheets in the first side consecutive printing period and the second side consecutive printing period and do not a small number of operations in the duplex printing for a single recording sheet while printing a significantly large number of recording sheets in the duplex printing mode in the alternate printing period.

Accordingly, in the present embodiment, when the misregistration correction mode is executed, the image forming apparatus 100 performs the interleaf control to form the detection image KG on both sides of recording sheets in the alternate printing period. Further, the number of recording sheets to form the detection image KG can be determined appropriately by a user. Therefore, the misregistration of image positions on both sides can be corrected by increasing the number of sample reference images. By increasing the number of reference images to be detected for averaging, the variation in misregistration of image positions on both sides of a recording sheet can be reduced, and therefore the misregistration can be corrected highly precisely. For example, multiple recording sheets are detected for a highly precise correction and a single recording sheet is detected for a quick correction. By so doing, any misregistration of image positions on both sides of a recording sheet corrected according to user's demands.

The number of recording sheets to be conveyed for formation of the detection image KG on both sides of each recording sheet depends on the configuration of an image forming apparatus (a distance of conveyance of each recording sheet passing through the secondary transfer nip region to reaching the sheet feeding passage 30 again) and the length of each recording sheet in the sheet conveying direction.

Examples of configurations of image forming apparatuses are described in Table 1 and Table 2 as follows.

TABLE 1

| Image Forming Apparatus A. | | | |
|---|---|---|---|
| SHEET LENGTH | NUMBER OF INTERLEAF SHEETS | NUMBER OF SHEETS FOR ADJUSTMENT IN 3-SHEET INTERLEAF CONTROL | NUMBER OF SHEETS FOR ADJUSTMENT IN 5-SHEET INTERLEAF CONTROL |
| (1) Up to 215.9 mm (Letter in Landscape Orientation) | 5 | 12 | 14 |
| (2) 216.0 through 431.8 mm (DL Envelope in Portrait Orientation) | 4 | 10 | 12 |
| (3) 431.9 mm through 487.7 mm (19.2 inch.) | 3 | 8 | 10 |

TABLE 2

| Image Forming Apparatus B. | | | |
|---|---|---|---|
| SHEET LENGTH | NUMBER OF INTERLEAF SHEETS | NUMBER OF SHEETS FOR ADJUSTMENT IN 3-SHEET INTERLEAF CONTROL | NUMBER OF SHEETS FOR ADJUSTMENT IN 5-SHEET INTERLEAF CONTROL |
| (1) Up to 215.9 mm (Letter in Landscape Orientation) | 8 | 18 | 20 |
| (2) 216.0 through 297.0 mm (A4 in Portrait Orientation) | 7 | 16 | 18 |
| (3) 297.1 mm through 364.0 mm (B4 in Portrait Orientation) | 6 | 14 | 16 |
| (4) 364.1 mm through 487.7 mm (19.2 inch.) | 5 | 12 | 14 |
| (5) 487.8 mm through 700.0 mm | 4 | 10 | 12 |

For example, when printing the detection image KG on both sides of three A3-size sheets, each having a length of 420 mm in the sheet conveying direction, using the image forming apparatus A of Table 1, the number of interleaf sheets are four. When performing a 4-sheet interleaf control, as illustrated in FIG. 2B, the alternate printing period starts from a fourth recording sheet. The gap between a third recording sheet and the fourth recording sheet is greater than the length of a single recording sheet, and therefore the fourth recording sheet is to pass through the fixing nip region having a high fixing temperature. Accordingly, in this case, the detection image KG is printed on both sides of a fifth recording sheet through a seventh recording sheet. An eight recording sheet through a tenth recording sheet are used as recording sheets to be conveyed for printing the detection image KG on the second side of the fifth through seventh recording sheets in the alternate printing period.

It is to be noted that a first recording sheet through the fourth recording sheet and the eighth through the non-detection sheets, and therefore are to be output without printing the detection image KG.

By ejecting the first through fourth and eighth through tenth recording sheets without printing the detection image KG, non-detection recording sheets that have no images on both sides can be reused. As a result, a smaller number of recording sheets is wasted.

In addition, the amount of toner consumption is reduced to perform an environment friendly correction of misregistration of image positions.

Further, a small number of reference images can be printed on a non-detection recording sheet that is not used for detection.

Alternatively, directions of output of recording sheets can be changed. Specifically, recording sheets having the detection image KG on both sides are output to the sheet output tray 53 and other non-detection recording sheets (conveyed in the first side consecutive printing period and the second side consecutive printing period) are output to the purge tray 58.

Figure 27:
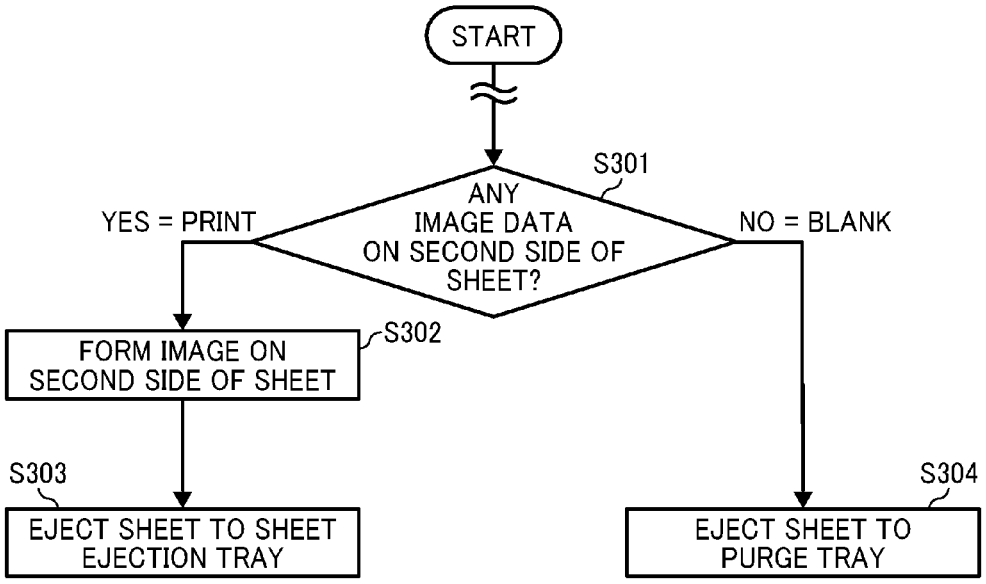
FIG. 27 is a flowchart of an example of a sheet ejection control in the interleaf control.

FIG. 27 is a flowchart of an example of a sheet ejection control in the interleaf control.

As illustrated in a flowchart of FIG. 27, when there is no image data to be printed on the second side of the recording sheet P (NO in step S301), the recording sheet P is conveyed to the re-entry passage 54 and then passes through the tray bound passage 57 to the purge tray 58, in step S304.

It is to be noted that, as illustrated in FIG. 1, the sheet conveying passage branches to the tray bound passage 57 before a path from the switchback passage 55 toward the post-switchback passage 56. Therefore, in the first side consecutive printing period and the second side consecutive printing period with the narrow gap between recording sheets, even when the non-detection sheet is conveyed to the re-entry passage 54, the recording sheet from the switchback passage 55 toward the post-switchback passage 56 and the recording sheet toward the purge tray 58 do not contact with each other.

By contrast, when there is image data to be printed on the second side of the recording sheet P (YES in step S301), the detection image KG is printed on the second side of the recording sheet P, in step S302. And then, the recording sheet P is conveyed to the pair of sheet output rollers 52 via the sheet ejecting passage 51 to be ejected to the sheet output tray 53 disposed outside the image forming apparatus 100, in step S303.

Figure 11:
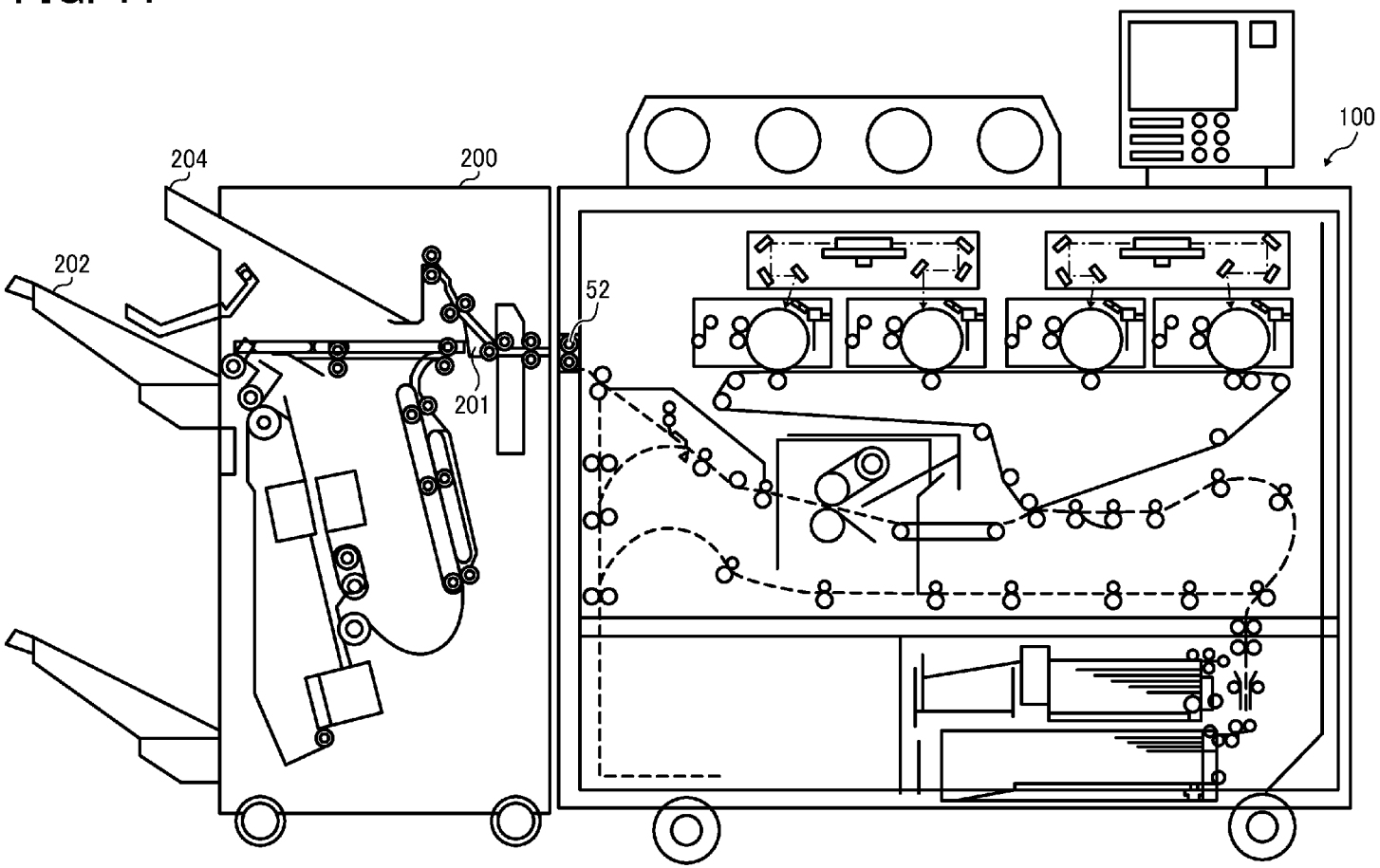
FIG. 11 is a diagram illustrating a configuration in which a finisher is connected to the image forming apparatus.

Further, as illustrated in FIG. 11, in a configuration in which the image forming apparatus 100 is connected to a finisher 200 and has multiple sheet output trays, detection recording sheets with the detection image KG on both sides and non-detection recording sheets can be ejected to different trays from each other.

Figure 12:
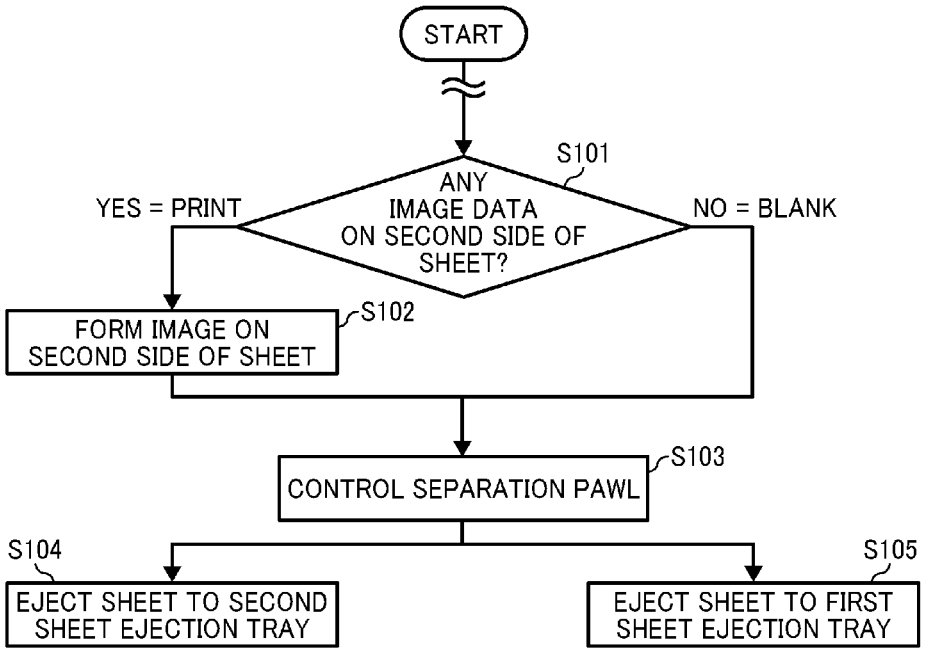
FIG. 12 is a flowchart of a different example of the interleaf control to determine a sheet ejecting target.

In this case, as illustrated in the flowchart of FIG. 12, the recording sheet P passes through the post-switchback passage 56 to be conveyed to the sheet feeding passage 30 again. When there is no image data for the second side (NO in step S101), the recording sheet P is output to the pair of sheet outlet rollers 52. Then, when a branching pawl 201 of the finisher 200 is controlled in step S103, the non-detection sheet and not having the reference image on both sides is output to a first sheet output tray 204, in step S105.

By contrast, when there is image data for the second side (YES in step S101), after the detection image KG is formed on the second side of the recording sheet P, in step S102, the pair of sheet output rollers 52 conveys the recording sheet P to the finisher 200. Then, when the branching pawl 201 of the finisher 200 is controlled in step S103, the recording sheet P is output to a second sheet output tray 202, in step S104.

It is to be noted that the above-described operation describes details of a sheet output operation in step S3 of the flowchart of FIG. 9.

As described above, by using different sheet trays for outputting the non-detection sheet and the recording sheet used for detection, a user does not sort the recording sheet used for detection and the non-detection sheet, which can save the user from doing the sorting.

In addition, when performing an operation of obtaining further information of the position of the detection image KG, the non-detection sheet is prevented from being mixed with the recording sheet for detection.

In the operations described above, presence or absence of image data for the second side of the recording sheet P determines whether or not the recording sheet P has the detection image KG on both the first side and the second side. However, the image forming apparatus 100 can further include a sensor on the sheet conveying passage to detect whether or not the recording sheet P has the detection image KG on the first side, so that whether or not the recording sheet P is used for detection can be determined based on the detection result of the sensor.

After the operation to form the detection image KG on both sides of the recording sheet P has been completed, the controller 20 starts counting, in step S4 of FIG. 9. Consequently, the user sets the output recording sheet P having the detection image KG on both sides in a specified sheet tray.

After the recording sheet P having the detection image KG on both sides has been set in the specified sheet tray, the detection recording sheet is conveyed to the position detecting device 10 to detect the position of the detection image KG on the first side. Hereinafter, the recording sheet having the reference image on both sides is referred to as a "detection recording sheet". Accordingly, the specified sheet tray holds the detection recording sheet so that the first side faces up and the leading end with the reference image on the first side corresponds to the leading end in the sheet conveying direction. Unless the recording sheet is set in the specified sheet tray as described above, the misregistration of image position of the detection recording sheet cannot be corrected with a high precision.

Accordingly, the image forming apparatus 100 according to the present embodiment guides the user to set the detection recording sheet in the specified sheet tray properly. Specifically, after the completion of image formation of the detection image KG on both sides of the detection recording sheet, the controller 20 displays information to indicate a sheet tray to set the detection recording sheet on a display 8*a* of the control panel 8 illustrated in FIG. 1. In this case, the display 8*a* functions as a setting error prevention controller 28 including a guide. Further, the controller 20 causes the display 8*a* of the control panel 8 to indicate how to set the detection recording sheet to the proper sheet tray with animated instructions.

Generally, a detection recording sheet having the detection image KG on both sides is ejected to a sheet output tray with the second side facing up. Further, the leading end of the detection recording sheet ejected to the sheet output tray is the trailing end in the sheet conveying direction when the detection image KG is formed on the first side of the detection recording sheet. Accordingly, when the detection recording sheet ejected on the sheet output tray is set to the sheet tray, the detection recording sheet is reversed with the trailing end of the detection recording sheet to face the leading end in the sheet conveying direction. In other words, the detection recording sheet is reversed to direct the sheet conveying direction before setting the sheet tray.

Accordingly, the display 8*a* of the control panel 8 informs a user by displaying animated instructions that the user is to reverse the detection recording sheet before setting the detection recording sheet in the sheet tray. By displaying the animated instructions on the display 8*a* of the control panel 8, the image forming apparatus 100 can guide the user to set the detection recording sheet in the specified sheet tray properly, thereby preventing sheet setting errors.

In addition to the above-described visual information, phonetic information using an audio device such as a speaker can be employed to guide the user to set the detection recording sheet properly. That is, in the present embodiment, a visual device such as the display 8*a* and an audio device such as a speaker function as a guide.

Since the same frame line image is formed as a reference image on both sides of a detection recording sheet, it is likely to be difficult to distinguish the first side of the detection recording sheet from the second side and the leading end of the detection recording sheet from the trailing end when setting the detection recording sheet in the sheet tray.

Figure 13A:
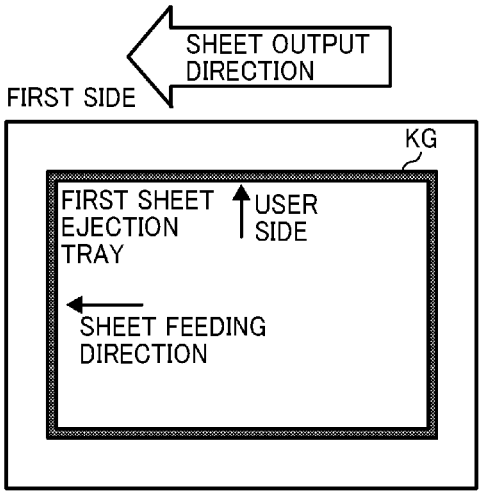
FIG. 13A is a diagram illustrating an example of a first side of a detection recording sheet having a reference image for proper setting on a sheet tray.
Figure 13B:
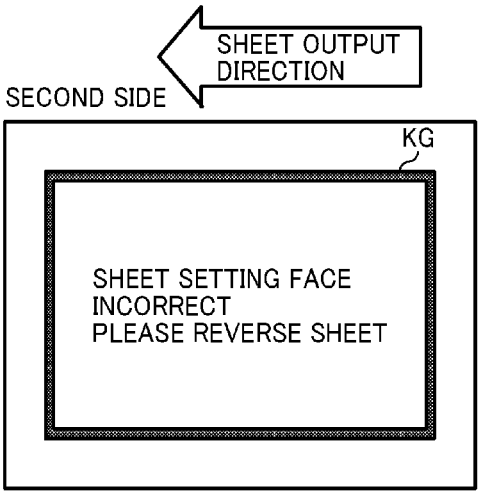
FIG. 13B is a diagram illustrating an example of a second side of the detection recording sheet having the reference image form proper setting on the sheet tray.

In order to address this inconvenience, as illustrated in FIGS. 13A and 13B, it is preferable that the setting error prevention controller 28 including a guide causes the process units 2Y, 2M, 2C, and 2K to form a different image other than the detection image KG on the detection recording sheet to be printed so as for the user to set the detection recording sheet in the sheet tray properly.

As illustrated in FIG. 13A, an image to indicate information of a sheet tray (i.e., the first sheet container 101 in FIG. 13A) to contain the detection recording sheet, the sheet conveying direction, and a user-side direction are formed on the first side of the detection recording sheet. Further, as illustrated in FIG. 13B, an image for the user to inform that the setting face of the detection recording sheet is not correct and that the detection recording sheet is to be reversed before setting to the sheet tray. By printing the images of the above-described information on a detection recording sheet, the image forming apparatus 100 can guide the user to set the detection recording sheet in the specified sheet tray properly, thereby preventing sheet setting errors. Specifically, the image to indicate information of a sheet tray to set the detection recording sheet, the sheet conveying direction, and the user-side direction and the image of instructions to the user to reverse and set the detection recording sheet include functions as a guide.

Further, sheet trays other than the specified sheet tray to load the detection recording sheet thereon may be locked by the setting error prevention controller 28, so as not to be pulled out from the housing 100*a* of the image forming apparatus 100. In this case, when the image formation of the detection image KG on both sides of the detection recording sheet is finished, the controller 20 causes sheet trays other than the specified sheet tray to be locked. By so doing, sheet setting errors caused by the user can be prevented.

Figure 14:
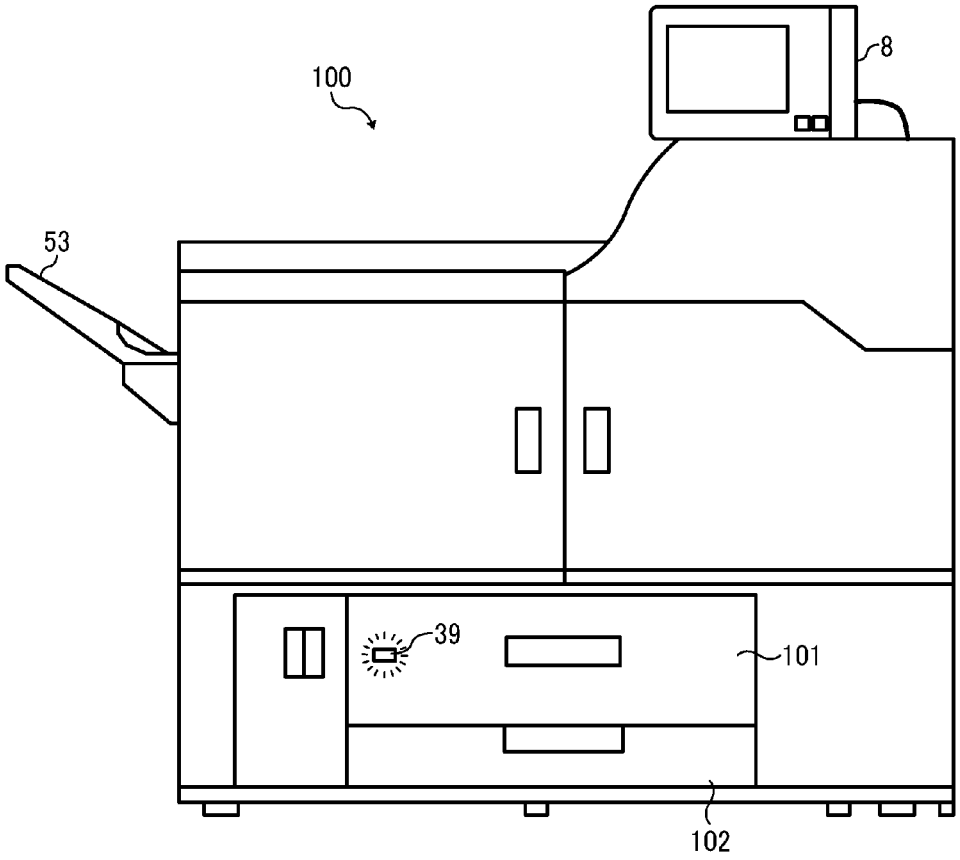
FIG. 14 is a diagram illustrating a first sheet tray with a light emitting part.

Further, as illustrated in FIG. 14, the first sheet container 101 includes a light emitting part 39 such as an LED. After completion of the image formation of the detection image KG on both sides of the detection recording sheet, the controller 20 causes the light emitting part 39 that functions as a guide of the sheet error prevention controller 28 to light so as to guide the user to set the detection recording sheet to the specified sheet tray properly. By so doing, sheet setting errors caused by the user can be prevented.

As illustrated in FIG. 9, when the image formation of the detection image KG on both sides of the detection recording sheet is finished, the controller 20 monitors whether or not the user has set the detection recording sheet to the specified sheet tray (i.e., the first sheet container 101 in the present embodiment), in step S5.

Whether or not the user has set the detection recording sheet to the specified sheet tray (i.e., the first sheet container 101 in the present embodiment) can be determined, for example, by detecting that the specified sheet tray is opened and detached from the housing 100*a* of the image forming apparatus 100, and that the specified sheet tray is then closed and attached back to the housing 100*a* (that the specified sheet tray is pulled out from the housing 100*a* and then inserted into the housing 100*a* again). After opening and closing (detachment and attachment) of the specified sheet tray relative to the housing 100*a* of the image forming apparatus 100, the controller 20 interprets that the detection recording sheet is set to the specified sheet tray (YES in step S5), the procedure goes to step S6.

In image formation of the detection image KG on both sides of the recording sheet P, the specified number of recording sheets is set in a predetermined sheet tray to be conveyed. When the predetermined sheet tray serves as a sheet container that contains the detection recording sheet, the setting of the detection recording sheet is detected as follows. Specifically, the setting of the detection recording sheet is detected when the detection recording sheet moved to a sheet feeding position at which the detection recording sheet contacts the sheet feed roller to be fed forward, from a sheet retracting position at which the detection recording sheet is separated from the sheet feeding position. When the specified number of recording sheets is set in a predetermined sheet tray to be conveyed in the image formation of the detection image KG on both sides of the recording sheet P, after the image formation has been performed, it is detected that the predetermined sheet tray is at a state of a paper end. Even if the user has set the detection recording sheet to a sheet tray other than the specified sheet tray by mistake, the predetermined sheet tray remains detected the paper end. When the detection recording sheet is set in the predetermined sheet tray, the detection recording sheet contacts the sheet feed roller, and stops detecting the paper end. Therefore, in this configuration, when the detection recording sheet stopped detecting the paper end, the controller 20 determines that the detection recording sheet has been set in the predetermined sheet tray, and the procedure moves to the following operation. In this configuration, the existing paper end detection can be used as the setting detection of the detection recording sheet, and therefore the image forming apparatus 100 can achieve a reduction in manufacturing cost.

Further, the image forming apparatus 100 can perform an operation in which, when the detection recording sheet is set in the specified sheet tray, the display 8*a* of the control panel 8 displays a message to guide a user to press the start button on the control panel 8 so that the user can send instruction to start feeding the detection recording sheet. Then, when the user pressed the start button, the controller 20 determines that the detection recording sheet is set in the specified sheet tray, and the procedure moves to the following operation. In this configuration, the sheet feeding operation is performed after the user has confirmed the setting of the detection recording sheet in the specified sheet tray.

Accordingly, when the detection recording sheet is set in the specified sheet tray (YES in step S5), after the image forming of the detection image KG on both sides of the detection recording sheet is finished, the controller 20 checks whether or not a predetermined period of time has elapsed, in step S6.

When the predetermine period of time has not yet elapsed (NO in step S6), the procedure goes back to step S6.

When the predetermined period of time has elapsed (YES in step S6), the controller 20 starts feeding of the detection recording sheet set in the specified sheet tray, in step S7.

As described above, the recording sheet heated by the fixing device 40 contracts due to moisture evaporation. However, as the time passes, the temperature of the recording sheet decreases, so that the recording sheet returns to the original size. The user sees the reference image on the detection recording sheet having the original size and the normal temperature after a sufficient time has elapsed. Therefore, even if the detection recording sheet is conveyed to obtain the position information of the reference image of the detection recording sheet before the temperature of the detection recording sheet is decreased to return to the original size, the condition of the detection recording sheet becomes different when the user sees the reference image on the detection recording sheet. Accordingly, an image position correction and a magnification error correction cannot be performed with high precision.

Further, there may be a case that the position of the reference image is detected in a state in which the detection recording sheet is not cooled enough to the normal temperature and the size of the detection recording sheet is not yet stable. Even if the magnification error of the reference image is corrected based on the detection results, the sizes of the images cannot be matched precisely.

In order to address this inconvenience, the image forming apparatus 100 according to the present embodiment starts the sheet feeding operation after the size of the detection recording sheet has returned to the original size. Specifically, after a predetermined period of time has elapsed from the completion of the image formation of the detection image KG on both sides of the detection recording sheet, the temperature of the detection recording sheet is sufficiently decreased, and then the size of the detection recording sheet becomes stable. Then, the controller 20 starts feeding the detection recording sheet. In other words, the controller 20 does not start feeding the detection recording sheet when the temperature of the detection recording sheet is above a predetermined temperature. By so doing, the position information of the reference image can be obtained in a stable size of the detection recording sheet, and therefore the image position correction and the magnification error correction can be performed with high precision.

In the present embodiment, the controller 20 starts feeding the detection recording sheet in a period from when the image formation of the detection image KG on both sides of the detection recording sheet is finished to when the temperature of the detection recording sheet is sufficiently decreased. However, the detection recording sheet can be fed by detecting the surface temperature of the detection recording sheet set in the specified sheet tray. Specifically, the image forming apparatus 100 further includes a temperature sensor to detect the surface temperature of the detection recording sheet set in the specified sheet tray. Then, after detecting that the detection recording sheet is set in the specified sheet tray, the controller 20 checks the temperature of the temperature sensor. When the temperature of the temperature sensor is equal to or smaller than a threshold value, the sheet feeding operation is started. Accordingly, by including the temperature sensor to detect the temperature of the detection recording sheet dropping sufficiently, the sheet feeding operation can be started earlier than the predetermined time depending on sheet types and environment of the image forming apparatus 100.

As illustrated in FIG. 9, when the sheet feeding operation starts, the detection recording sheet set in the specified sheet tray is conveyed toward the position detecting device 10 and the position information of the detection image KG formed on the first side of the detection recording sheet. The position information includes the leading end margin length L1, the image length L2, the trailing end margin length L3, the width margin length W1, and the image width W2.

Further, the detection recording sheet that has passed the position detecting device 10 travels through the transfer belt device 35, the fixing device 40, the conveyance direction switching device 50, the re-entry passage 54, the switchback passage 55, and the post-switchback passage 56 before reaching the sheet feeding passage 30. Then, the detection recording sheet is conveyed toward the position detecting device 10. Then, the position detecting device 10 obtains the position information of the detection image KG on the second side of the detection recording sheet, step S8. Then, the detection recording sheet that has passed through the position detecting device 10 is output to the sheet output tray 53.

When there are multiple detection recording sheets, the position information of the reference image on both sides of each of the multiple detection recording sheets may be obtained by conveying the multiple detection recording sheets in the interleaf control.

The detection recording sheet passes through the fixing device 40 after the position information of the detection image KG on the first side of the detection recording sheet is obtained. At this time, when heat is conducted from the fixing device 40 to the detection recording sheet, the detection recording sheet is contracted. This reduction in size of the detection recording sheet hinders a highly precise correction of magnifications. Therefore, the configuration according to the present embodiment prevents application of heat from the fixing device 40 to the detection recording sheet when obtaining the position information of the image on the detection recording sheet.

Figure 15A:
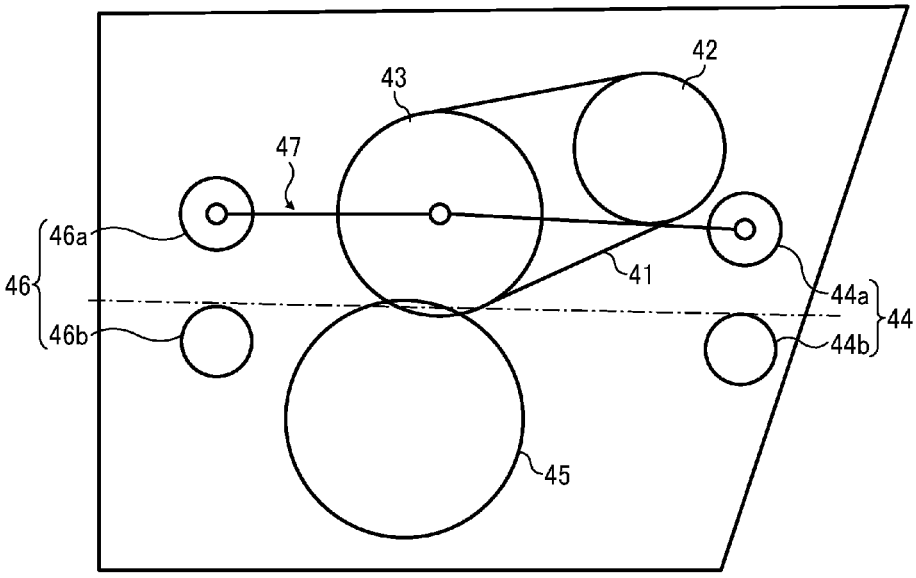
FIG. 15A is a diagram illustrating a fixing device with a heat roller and a fixing roller in contact with each other.
Figure 15B:
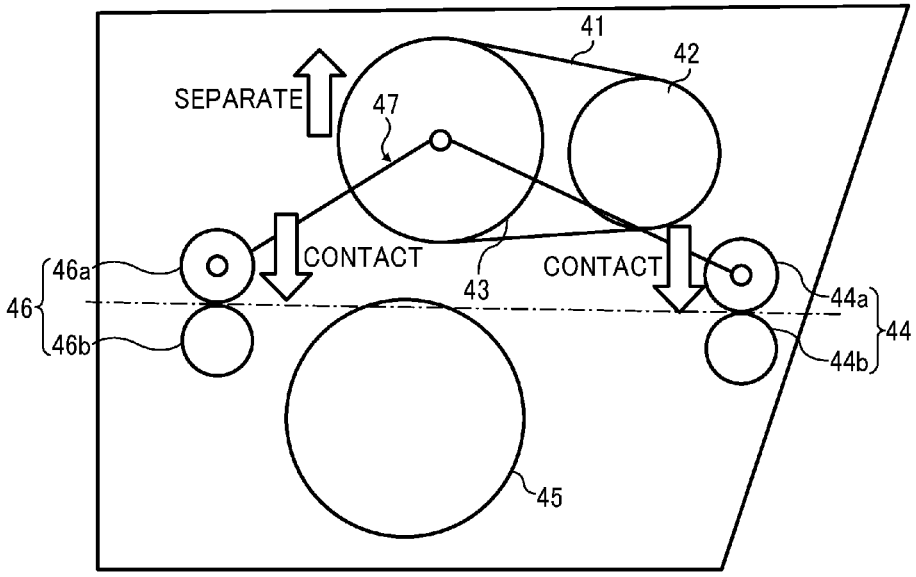
FIG. 15B is a diagram illustrating the fixing device with the heat roller and the fixing roller separated from each other.

FIG. 15A is a diagram illustrating the fixing device 40 according to the present embodiment, with a heat roller 42 and a fixing roller 43 in contact with each other. FIG. 15B is a diagram illustrating the fixing device 40 according to the present embodiment, with the heat roller 42 and the fixing roller 43 separated from each other.

As illustrated in FIGS. 15A and 15B, a fixing belt 41 that functions as a fixing body that is wound around a heat roller 42 that functions as a heating body and a fixing roller 43. The heat roller 42 is heated by the heating body such as a heater included therein to heat the fixing belt 41 that is wound around the heat roller 42 and the fixing roller 43. A driving force is exerted by a drive source and is transmitted to the fixing roller 43. Along with rotation of the fixing roller 43, the fixing belt 41 rotates so that the fixing belt 41 is uniformly heated to a predetermined temperature.

Further, a pressure roller 45 that functions as a pressing body is disposed at a position facing the fixing roller 43 with the fixing belt 41 interposed between the pressure roller 45 and the fixing roller 43. The pressure roller 45 is pressed by a pressing mechanism to the center of the fixing roller 43 via the fixing belt 41. Consequently, a fixing nip region is formed between the fixing belt 41 and the pressure roller 45.

A pair of sheet conveying rollers 44 and a pair of sheet conveying rollers 46 are disposed upstream and downstream from the fixing nip region in the sheet conveying direction, respectively. The pair of second sheet conveying rollers 44 includes a first sheet conveying roller 44*a* and a second sheet conveying roller 44*b*. The pair of second sheet conveying rollers 46 includes a first sheet conveying roller 46*a* and a second sheet conveying roller 46*b*. The first sheet conveying rollers 44*a* and 46*a* are disposed closer from the sheet conveying passage of the pairs of sheet conveying rollers 44 and 46 than the second sheet conveying rollers 44*b* and 46*b*. The first sheet conveying rollers 44*a* and 46*a* can contact and separate relative to the second sheet conveying rollers 44*b* and 46*b*, respectively. The fixing roller 43 can contact and separate relative to the pressure roller 45.

The fixing roller 43 is connected to the first sheet conveying rollers 44*a* and 46*a* via a link mechanism 47. When the fixing roller 43 is in contact with the pressure roller 45 via the fixing belt 41, as illustrated in FIG. 15A, the link mechanism 47 causes the first sheet conveying rollers 44*a* and 46*a* to separate from the second sheet conveying rollers 44*b* and 46*b*. By contrast, when the fixing roller 43 is separated from the pressure roller 45, as illustrated in FIG. 15B, the link mechanism 47 causes the first sheet conveying rollers 44*a* and 46*a* to contact the second sheet conveying rollers 44*b* and 46*b*. A driving force is exerted by a driving force and is transmitted to the first sheet conveying rollers 44*a* and 46*a*. The driving force rotates the first sheet conveying rollers 44*a* and 46*a* function as a drive roller. Alternatively, a single drive source to drive the fixing roller 43 can rotate the first sheet conveying rollers 44*a* and 46*a*. Further alternatively, a drive source to drive the fixing roller 43 and another drive source to drive the first sheet conveying rollers 44*a* and 46*a* can be provided to the image forming apparatus 100.

When forming an image, as illustrated in FIG. 15A, the fixing roller 43 contacts the pressure roller 45 with the fixing roller 43 holding the fixing belt 41 to form the fixing nip region. By application of heat and pressure, a toner image on the recording sheet is fixed to the recording sheet.

By contrast, after the image formation of the detection image KG on both sides of the detection recording sheet, the heating body (e.g., a heater) in the heat roller 42 is turned off. Then, as illustrated in FIG. 15B, the fixing roller 43 is separated from the pressure roller 45 and the first sheet conveying rollers 44*a* and 46*a* contact the second sheet conveying rollers 44*b* and 46*b*, respectively. By so doing, when obtaining the position information of the reference image, the detection recording sheet is conveyed in the fixing device 40 by the pairs of sheet conveying rollers 44 and 46. Therefore, heat is not applied from the fixing belt 41 to the detection recording sheet. As a result, thermal contract of the detection recording sheet when obtaining the position information of the reference image on the detection recording sheet.

The above-described configuration includes the link mechanism 47 to cause the fixing roller 43 to contact and separate from the pressure roller 45 and the first sheet conveying rollers 44*a* and 46*a* to contact and separate from the second sheet conveying rollers 44*b* and 46*b*. However, a configuration to be applied to this disclosure is not limited thereto. For example, this disclosure can be effective with a configuration in which a mechanism to cause the fixing roller 43 to contact and separate from the pressure roller 45 and another mechanism to cause the first sheet conveying rollers 44*a* and 46*a* to contact and separate from the second sheet conveying rollers 44*b* and 46*b*, respectively.

Figure 16A:
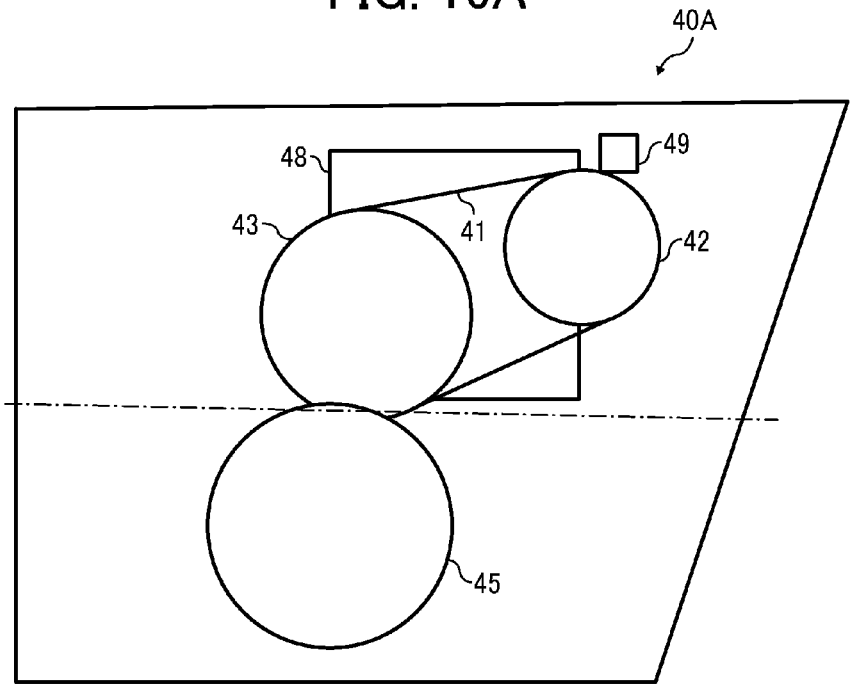
FIG. 16A is a cross sectional view illustrating a fixing device that is a variation of the fixing device of FIGS. 15A and 15B.
Figure 16B:
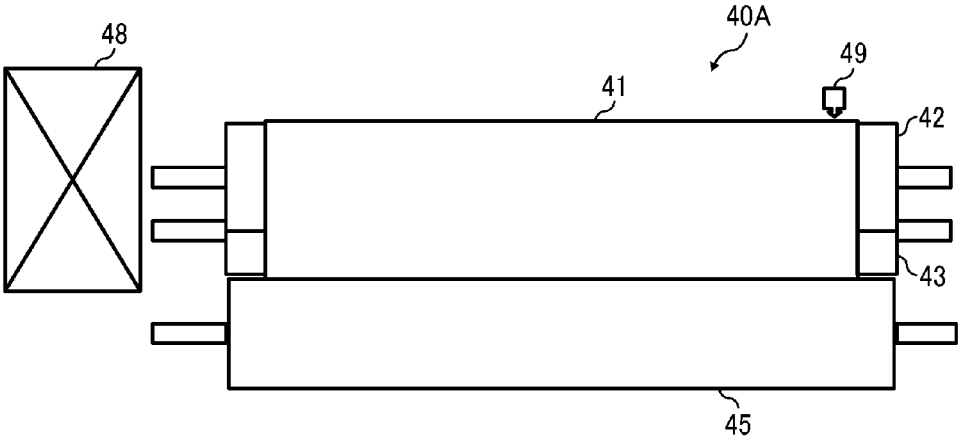
FIG. 16B is a diagram illustrating the fixing device viewed in a sheet conveying direction.

FIG. 16A is a cross sectional view illustrating a fixing device 40A that is a variation of the fixing device 40. FIG. 16B is a diagram illustrating the fixing device 40A viewed in the sheet conveying direction.

As illustrated in FIG. 16B, the fixing device 40A includes a cooling fan 48 to cool the fixing device 40A. By cooling the fixing device 40A, by air with the cooling fan 48, the detection recording sheet is not adversely affected by heat from the fixing device 40A when the position information of the reference image is obtained.

As illustrated in FIG. 16B, the cooling fan 48 is disposed at one axial end of the fixing device 40A that is a variation of the fixing device 40. Specifically, the cooling fan 48 is disposed facing one end in the width direction of the fixing belt 41.

The fixing device 40A further includes a temperature sensor 49 to measure the surface temperature of the fixing belt 41 of the fixing device 40A.

When the image formation of the detection image KG on both sides of the detection recording sheet is finished, the heating body (e.g., a heater) in the heat roller 42 is turned off and the cooling fan 48 is turned on so as to cool the fixing belt 41, the heat roller 42, and the fixing roller 43. At this time, a cooling operation is performed while the fixing roller 43 rotates to rotate the fixing belt 41. The controller 20 monitors the temperature of the temperature sensor 49. When the temperature sensor 49 detects that the surface temperature of the fixing belt 41 is cooled by the cooling fan 48 and becomes equal to or smaller than a threshold value, the controller 20 starts the sheet feeding operation of the detection recording sheet. According to this configuration of the variation, heat is not applied from the fixing belt 41 to the detection recording sheet. As a result, thermal contract of the detection recording sheet when obtaining the position information of the reference image on the detection recording sheet.

Further, the fixing device 40 may be designed to be detachably attached to the housing 100*a* of the image forming apparatus 100. That is, the fixing device 40 can be detached from the housing 100*a* when the position information of the image is obtained and a device including a pair of sheet conveying rollers to convey the detection recording sheet is attached to the housing 100*a* instead. According to this alternative configuration, the detection recording sheet is not adversely affected by heat applied by the fixing device 40 when obtaining the image position information. By contrast, the detection recording sheet can be prevented from decreasing in size by heat applied by the fixing device 40 when the image position information is obtained. According to this alternative configuration, the detection recording sheet is not adversely affected by heat applied by the fixing device 40 when obtaining the image position information. By contrast, the detection recording sheet can be prevented from decreasing in size by heat applied by the fixing device 40 when the image position information is obtained.

Further, when the detection recording sheet is output to a single sheet output tray, in the image formation of the detection image KG on both sides of the detection recording sheet, the detection recording sheet having the detection image KG on both sides of the detection recording sheet and the non-detection recording sheet (the recording sheet printed and conveyed in a printing period other than the alternate printing period) are ejected to the same sheet output tray. As described above, by using different sheet trays for outputting the detection recording sheet and the non-detection sheet, the detection recording sheet and the non-detection sheet are to be sorted, which is a time-consuming job. In addition, it is likely that the non-detection sheet is not removed and is set in the specified sheet tray with the detection recording sheet. Accordingly, it is preferable to obtain the position information of the image without any error even when the non-detection sheet is mixed in the specified sheet tray.

Figure 17:
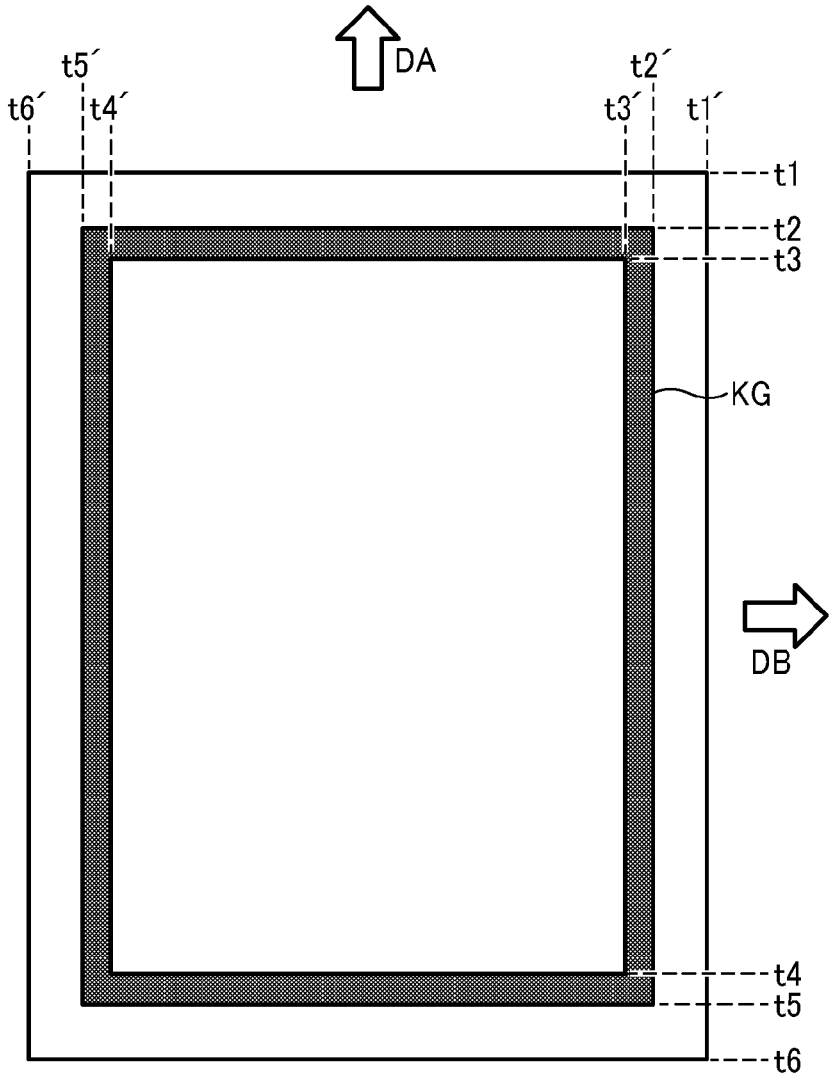
FIG. 17 is a diagram illustrating timings of changes in output of a sensor when detecting the image formed on the detection recording sheet.

FIG. 17 is a diagram illustrating timings of changes in output of the start trigger sensor 13 and the stop trigger sensor 14 when detecting the image formed on the detection recording sheet.

As illustrated in FIG. 17, when the recording sheet is conveyed in a direction indicated by arrow DA in FIG. 17 (hereinafter, referred to as a direction DA), outputs change for 6 times as indicated by times t1, t2, t3, t4, t5, and t6 after the start of conveyance of the recording sheet. Similarly, when the recording sheet is conveyed in a direction indicated by arrow DB in FIG. 17 (hereinafter, referred to as a direction DB), after the start of conveyance of the recording sheet, outputs change for 6 times as indicated by times t1', t2', t3', t4', t5', and t6'.

A relatively large detection image KG that includes a frame line is printed on the detection recording sheet. Due to this reason, a margin length from one end in the length of the recording sheet to the detection image KG is substantially same as a margin length from one end in the width of the recording sheet to the detection image KG. Therefore, when the recording sheet is conveyed in the direction DA and when the recording sheet is conveyed in the direction DB, a timing of changing the output from OFF to ON when the leading end of the recording sheet in the sheet conveying direction passes by the stop trigger sensor 14 and a timing of changing the output from ON to OFF when the leading end of the detection image KG passes by the stop trigger sensor 14 are substantially same as each other.

Figure 18A:
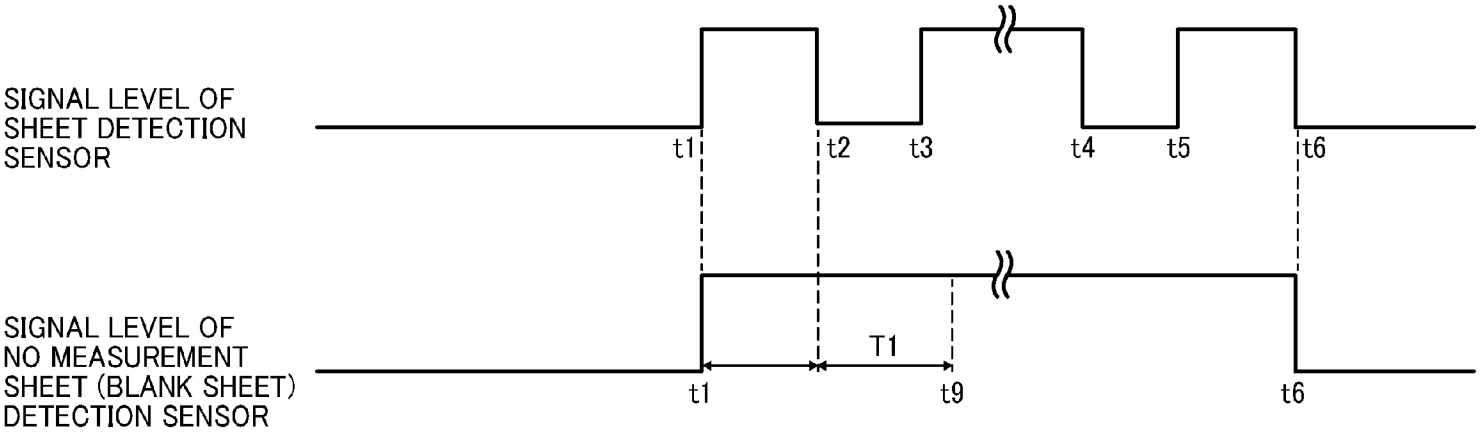
FIG. 18A is a diagram illustrating changes in output of a sensor when the detection recording sheet and the blank recording sheet pass the position detecting device.
Figure 18B:
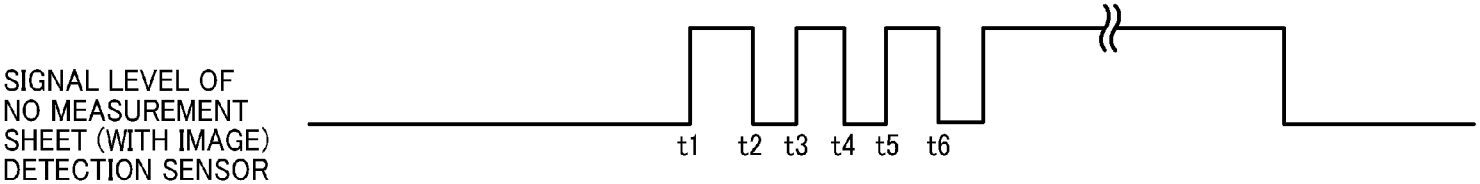
FIG. 18B is a diagram illustrating changes in output of the sensor when the recording sheet having images passes the position detecting device.
Figure 19:
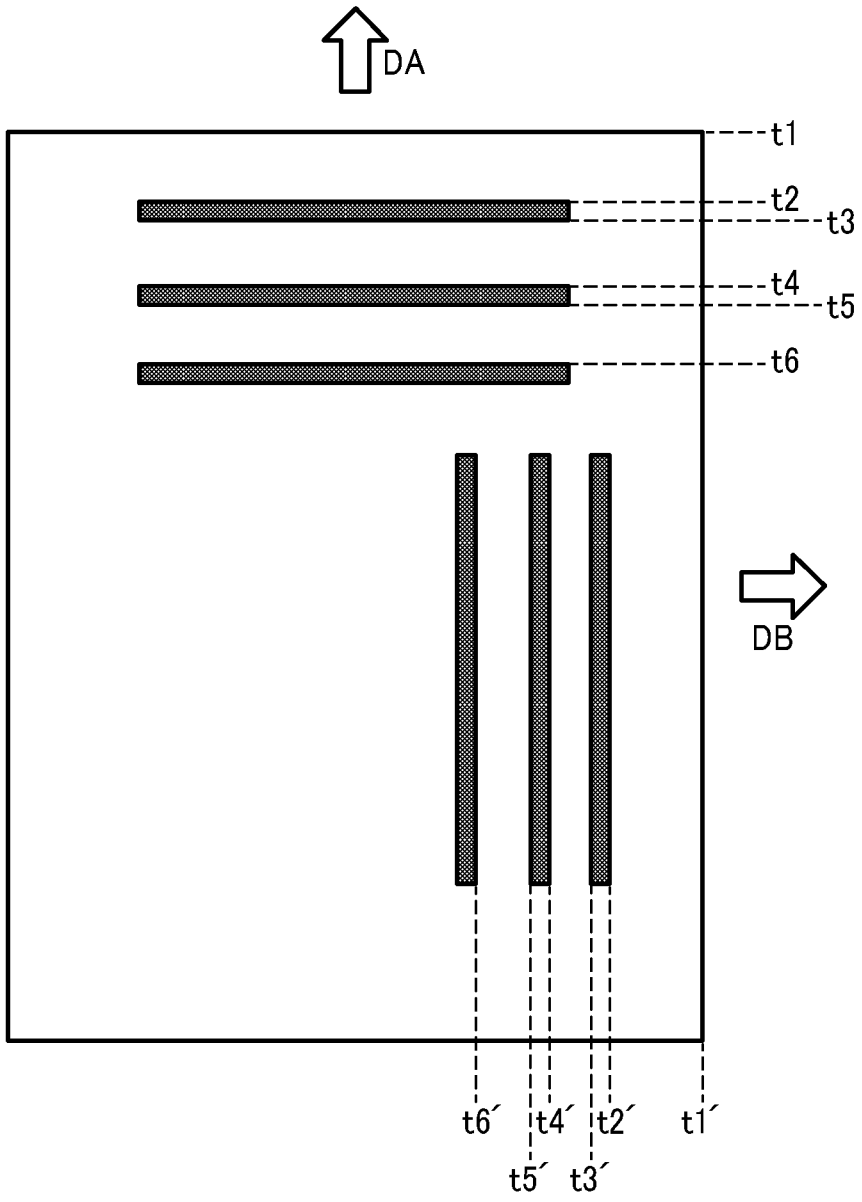
FIG. 19 is a diagram illustrating an example of a requisite minimum image on a non-detection recording sheet in the image formation of the detection image on both sides of the recording sheet.

FIG. 18A is a diagram illustrating changes in output of the stop trigger sensor 14 when the detection recording sheet and the blank recording sheet pass the position detecting device 10. FIG. 18B is a diagram illustrating changes in output of the stop trigger sensor 14 when the recording sheet having images of FIG. 19 passes the position detecting device 10. FIG. 19 is a diagram illustrating an example of a requisite minimum image on the non-detection sheet in the image formation of the detection image KG on both sides of the detection recording sheet.

As illustrated in FIG. 18A, when the detection recording sheet passes the position detecting device 10, the output values of the stop trigger sensor 14 change for six (6) times at predetermined timings. By contrast, when the blank recording sheet passes the position detecting device 10, the output values of the stop trigger sensor 14 changes for two (2) times.

When the output value of the stop trigger sensor 14 does not change from ON to OFF from when the stop trigger sensor 14 detected the passage of the leading end of the recording sheet in the sheet conveying direction until a time T1, the controller 20 determines that the recording sheet conveyed to the position detecting device 10 is a blank recording sheet. Then, even when the stop trigger sensor 14 detects the leading end of the recording sheet in the sheet conveying direction, the controller 20 does not count the pulses of the rotary encoder 18 and causes the recording sheet to be discharged without obtaining the position information of the image. It is to be noted that the recording sheet is determined to be a blank recording sheet at a time t9. The time t9 is a time at which a position substantially 10 mm away from the leading end of the recording sheet to the upstream side in the sheet conveying direction when the detection image KG is formed at an ideal position passes the stop trigger sensor 14. Accordingly, the detection recording sheet and the blank recording sheet can be distinguished highly precisely even when the recording sheet is conveyed in either one of the direction DA and the direction DB illustrated in FIG. 17. Therefore, even when the detection recording sheet and the non-detection sheet are mixed in the specified sheet tray, the position information of the image is obtained on the detection recording sheet and not on the non-detection sheet is not obtained. Consequently, in the image formation of the detection image KG on both sides of the recording sheet, even when the detection recording sheet and the non-detection sheet are mixed in the same sheet output tray, the recording sheets can be set in the specified sheet tray without sorting the detection recording sheet and the non-detection sheet. Consequently, the user can reduce the time for sorting the recording sheets.

Further, in the image formation of the detection image KG on both sides of the detection recording sheet, an image that can switch the output of the stop trigger sensor 14 for multiple times within a predetermined range can be formed on the non-detection sheet, as illustrated in FIG. 19. For the detection recording sheet, the output value of the stop trigger sensor 14 changes for three (3) times to the time t9, as illustrated in FIG. 18A.

By contrast, for the non-detection sheet, as illustrated in FIG. 19, the output values of the stop trigger sensor 14 changes six (6) times to the time t9 in FIG. 18B. Therefore, when the output values of the stop trigger sensor 14 changes four (4) or more times to the time t9, the controller 20 determines the recording sheet is a non-detection recording sheet, and therefore does not obtain the position information of the image. These determination is performed before the start trigger sensor 13 passes the leading end of the recording sheet. Therefore, the image formed on the non-detection recording sheet to cause the stop trigger sensor 14 to change the output values for four or more times is formed on the leading end of the recording sheet in the sheet conveying direction.

Consequently, in the configuration in which an image is formed on the non-detection recording sheet, by arranging the image to be formed on the non-detection recording sheet, even when the non-detection recording sheet is set in the specified sheet tray, the position information of the image on the detection recording sheet can be obtained without sorting the detection recording sheet and the non-detection recording sheet.

After the position information of the reference image on both sides of the detection recording sheet is obtained, the controller 20 calculates a positional shift amount and a magnification error based on the position information of the image obtained above, in step S9. Then, the controller 20 calculates a positional shift adjustment amount based on the positional shift amount and a magnification correction amount based on the magnification error, in step S10.

The positional shift calculating device 25 of the controller 20 calculates the positional shift amount. The positional shift calculating device 25 may calculate a positional shift amount of the reference image formed on one of the first side and the second side of the recording sheet P to the other of the first side and the second side of the recording sheet P or may calculate positional shift amounts of the images on both sides of the recording sheet P relative to an ideal image position.

The positional shift amount of the reference image formed on one of the first side and the second side of the recording sheet relative to the other of the first side and the second side of the recording sheet P may be calculated as follows.

It is to be noted that a "leading end margin length L1(1)" represents a leading end margin length of the first side of the recording sheet P, a "leading end margin length L1(2)" represents a leading end margin length of the second side of the recording sheet P, an "ideal leading end margin length L1(R)" represents an ideal leading end margin length of the recording sheet P, an "image length L2(1)" represents an image length in the sheet conveying direction of the first side image of the recording sheet P, an "image length L2(2)" represents an image length in the sheet conveying direction of the second side image of the recording sheet P, an "ideal image length L2(R)" represents an ideal image length of the recording sheet P a "width margin length W1(1)" represents a width margin length of the first side image of the recording sheet P, a "width margin length W1(2)" represents a width margin length of the second side image of the recording sheet P, an "ideal width margin length W1(R)" represents an ideal width margin length of the recording sheet P, an "image width W2(1)" represents an image width of the first side image on the recording medium P, an "image width W2(2)" represents an image width of the second side image on the recording medium P, and an "ideal image width W2(R)" represents an ideal image width of the recording medium P.

When the image on the first side of the recording sheet P is a reference image, the positional shift amount of the image formed on the second side of the recording sheet Pin the sheet conveying direction relative to the leading end of the image formed on the first side of the recording sheet P can be obtained by subtracting the leading end margin length L1(2) of the second side of the recording sheet P from the leading end margin length L1(1) of the first side of the recording sheet P.

When the obtained value is positive, a second side image is shifted toward the leading end of the recording sheet P relative to a first side image.

When the obtained value is negative, the second side image is shifted toward the trailing end of the recording sheet P relative to the first side image.

When handling multiple detection recording sheets, there are multiple leading end margin lengths L1(1) of the detected first side images and multiple leading end margin lengths L1(2) of the second side images. In such a case, respective positional shift amounts in the sheet conveying direction are calculated to be averaged.

The image position correcting device 27 of the controller 20 calculates an adjustment amount of a write start timing in a sub-scanning direction (how many lines to accelerate or decelerate) based on the calculated positional shift amount in the sheet conveying direction. Then, when forming an image on the second side of the recording sheet P, an image writing is started at the adjusted write start timing based on the calculated positional shift adjustment amount. By so doing, the position of the first side image in the sheet conveying direction and the position of the second side image can be matched with each other.

The positional shift amount in the sheet conveying direction relative to the ideal image position is calculated as follows.

An ideal leading end margin length L1(R) is previously stored in a non-volatile memory in the image forming apparatus 100. The positional shift amount relative to the ideal image position of the first side image is calculated by subtracting the leading end margin length L1(1) of the first side image from the ideal leading end margin length L1(R). When handling multiple detection recording sheets, there are measurement data of the multiple leading end margin lengths L1(1). In this case, respective positional shift amounts relative to the ideal image position are calculated to be averaged.

Further, the positional shift amount relative to the ideal image position of the second side image is calculated by subtracting the leading end margin length L1(2) of the second side image from the ideal leading end margin length L1(R). When handling multiple detection recording sheets, there are measurement data of the multiple leading end margin lengths L1 (2). In this case, respective positional shift amounts relative to the ideal image position are calculated to be averaged.

Next, based on the positional shift amounts in the sheet conveying direction relative to the ideal image position, an adjustment amount of a write start timing in the sub-scanning direction of the first side of the recording sheet P and an adjustment amount of a write start timing in the sub-scanning direction of the second side of the recording sheet P are calculated. Then, an image formation on the recording sheet P is started at the adjusted write start timings adjusted based on the calculated adjustment amounts. By so doing, both the first side image and the second side image are formed at the ideal image position in the sheet conveying direction. As a result, the position of the first side image in the sheet conveying direction and the position of the second side image in the width direction can be matched with each other.

The positional shift calculating device 25 of the controller 20 calculates the positional shift amount in the width direction. When the first side image of the recording sheet P is a reference image, the positional shift amount in the width direction of the second side image relative to the leading end of the first side image can be obtained by subtracting the width margin length W1(2) of the second side image of the recording sheet P from the width margin length W1(1) of the first side image of the recording sheet P. When handling multiple detection recording sheets, there are measurement data of the multiple width margin lengths W1(1) and of the multiple width margin length W1(2). In this case, respective positional shift amounts relative to the ideal image position are calculated to be averaged.

The image position correcting device 27 of the controller 20 calculates an adjustment amount of a write start timing in the sub-scanning direction (how many clocks to accelerate or decelerate) based on the calculated positional shift amount in the width direction. Then, when forming an image on the second side of the recording sheet P, an image writing is started at the adjusted mite start timing based on the calculated positional shift adjustment amount. By so doing, the position of the first side image in the width direction and the position of the second side image in the width direction can be matched with each other.

The positional shift amount relative to the ideal image position in the width direction is calculated as follows.

The positional shift amount relative to the ideal image position of the first side image is calculated by subtracting the width margin length W1(1) of the first side image from the ideal width margin length W1(R) stored in the non-volatile memory. Further, the positional shift amount relative to the ideal image position of the second side image is calculated by subtracting the width margin length W1(2) of the second side image from the ideal width margin length W1(R). When handling multiple detection recording sheets, there are measurement data of the multiple width margin lengths W1(1) and measurement data of the multiple width margin lengths W1(2). In this case, respective positional shift amounts relative to the ideal image position are calculated to be averaged.

Next, based on the positional shift amounts in the width direction relative to the ideal image position, an adjustment amount of a write start timing in a main scanning direction of the first side of the recording sheet P and an adjustment amount of a write start timing in the main scanning direction of the second side of the recording sheet P are calculated. Then, an image formation on the recording sheet P is started at the adjusted write start timings adjusted based on the calculated adjustment amounts. By so doing, both the first side image and the second side image are formed at the ideal image position in the width direction. As a result, the position of the first side image in the width direction and the position of the second side image in the width direction can be matched with each other.

The magnification error calculating device 24 of the controller 20 calculates magnification errors as follows.

When the first side of the recording sheet P is a reference image, the magnification error in the sheet conveying direction can be obtained by calculating a ratio (L2(1)/L2(2)) of the image length L2(1) of the first side image of the recording sheet P and the image length L2(2) in the sheet conveying direction of the second side of the recording sheet P. In addition, the magnification error in the width direction can be obtained by calculating a ratio (W2(1)/W2(2)) of the image width W2(1) of the first side image and the image width W2(2) of the second side image. When handling multiple detection recording sheets, there are measurement data of the multiple detection recording sheets. In this case, the ratio (L2(1)/L2(2)) and the ratio (W2(1)/W2(2)) are calculated to be averaged.

The image data correcting device 26 of the controller 20 calculates an image data correction amount based on the ratio (L2(1)/L2(2)) and the ratio (W2(1)/W2(2)), so that the size of the second side image matches the size of the first side image. Then, when forming an image on the second side of the recording sheet P, the image data is corrected based on the image data correction amount to form the image on the second side of the recording sheet By so doing, the size of the second side image can be matched with the size of the first side image.

A magnification error to an ideal image is obtained by calculating a ratio (L2(R)/L2(1)) of the ideal image length L2(R) that is stored in the non-volatile memory and the image length L2(1) of the first side image of the recording sheet P. It is to be noted that the ratio corresponds to the magnification error. Accordingly, the magnification error in the sheet conveying direction of the first side image relative to the ideal image is obtained.

Similarly, a magnification error (in the sheet conveying direction of the second side image relative to the ideal image, a magnification error in the width direction of the first side image relative to the ideal image, and a magnification error in the width direction of the second side image relative to the ideal image are obtained.

The image data correcting device 26 of the controller 20 calculates an image data correction amount based on the ratio (L2(R)/L2(1)) and the ratio (W2(R)/W2(1)), so that the size of the first side image matches the size of the ideal image. Similarly, the image data correcting device 26 of the controller 20 calculates an image data correction amount based on the ratio (L2(R)/L2(2)) and the ratio (W2(R)/W2(2)), so that the size of the second side image matches the size of the ideal image. Then, the image data of the first side image and the image data of the second side image are corrected based on the respective image data correction amounts. Accordingly, both the first side image and the second side image can have the size that matches the size of the ideal image. As a result, the size of the first side image and the size of the second side image can be matched with each other.

As described above, in the present embodiment, the positional shift and the magnification error of the second side image relative to the first side image formed on the recording sheet P by forming and detecting the detection images on both sides of the recording sheet P. Accordingly, the position and size of the image formed on the first side of the recording sheet P are matched with the position and size of the image formed on the second side of the recording sheet P. Further, respective positions of the first side image and the second side image are measured automatically. Therefore, when compared to a configuration in which the measurement of positions of the first side image and the second side image are performed manually, the configuration performing automatic measurements can save the user from doing the manual measurements. Further, the automatic measurements can avoid measurement errors and input errors, and therefore the positions and sizes of the images on both sides of a recording sheet can be adjusted precisely.

Further, by detecting the width margin length W1 for multiple times by the line sensor 15, a skew amount of the image relative to the recording sheet can be detected. By rotating image data based on the skew amount, the skew of the image can be corrected.

Further, the line sensor 15*a* disposed at one end in the width direction of a recording sheet detects the width margin length W1 for multiple times and the line sensor 15*b* disposed at the opposed end in the width direction of the recording sheet detects the width margin length W1 for multiple times. Based on the multiple results of the width margin lengths W1 detected by the line sensor 15*a* and the line sensor 15*b*, inclinations of an image at one end in the width direction and inclinations of the image at the opposed end in the width direction can be detected.

Accordingly, shape errors of both the first side image and the second side image can be detected. As a result, the shape of the first side image and the size of the second side image can be corrected to match with each other.

Next, a description is given of a position detecting device 10A according to a variation of the present embodiment of this disclosure.

Figure 20:
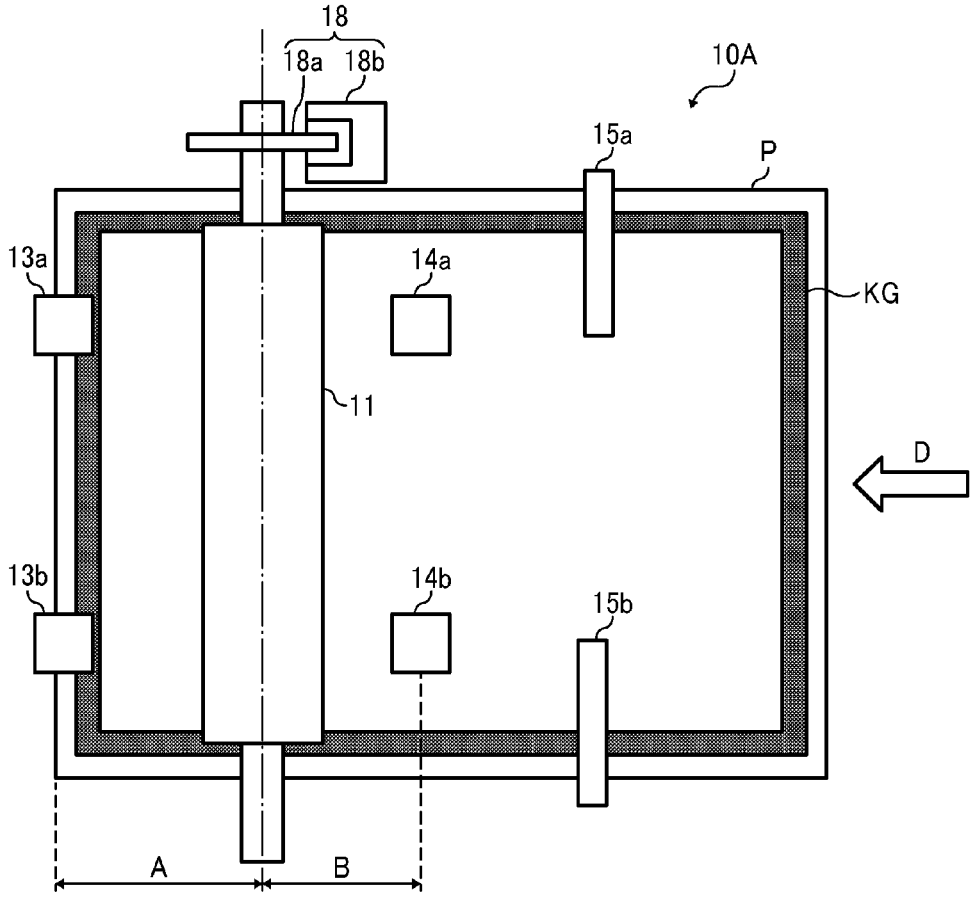
FIG. 20 is a schematic view illustrating a variation of the position detecting device together with the detection recording sheet.

FIG. 20 is a schematic view illustrating the position detecting device 10A together with the detection recording sheet according to the variation.

As illustrated in FIG. 20, the position detecting device 10A according to the variation includes two start trigger sensors (i.e., a first start trigger sensor 13*a* and a second start trigger sensor 13*b*) and two stop trigger sensors (i.e., a first stop trigger sensor 14*a* and a second stop trigger sensor 14*b*). The first start trigger sensor 13*a* and the second start trigger sensor 13*b* are aligned at the same position in the sheet conveying direction of the recording sheet P. The first stop trigger sensor 14*a* and the second stop trigger sensor 14*b* are aligned at the same position in the sheet conveying direction of the recording sheet P.

The first start trigger sensor 13*a* and the first stop trigger sensor 14*a* are aligned at the same position in the width direction of the recording sheet P. Similarly, the second start trigger sensor 13*b* and the second stop trigger sensor 14*b* are aligned at the same position in the width direction of the recording sheet P.

By including multiple start trigger sensors and multiple stop trigger sensors, the position detecting device 101 can detect the leading end margin lengths L1, the image lengths L2, and the trailing end margin lengths L3 at multiple positions in the width direction of the recording sheet P. As a result, the skew and shape of an image can be detected more precisely.

Figure 21:
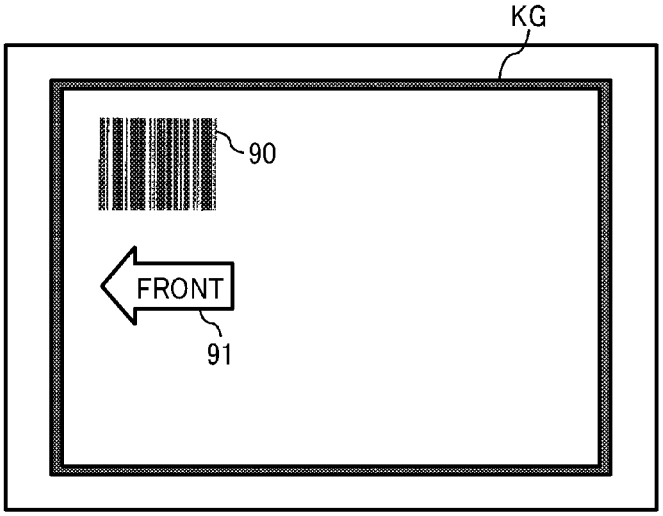
FIG. 21 is a diagram illustrating the detection recording sheet on which a reference image and a pattern code are formed.

Further, FIG. 21 is a diagram illustrating the detection recording sheet on which the detection image KG and a pattern code 90 are formed.

As illustrated in FIG. 21, the detection recording sheet has the detection image KG including a frame line together with a pattern code 90 such as a bar code indicating predetermined information of, for example, the first and second sides of the recording sheet P.

Then, the first stop trigger sensor 14*a* reads the pattern code 90. By so doing, measurement failure of image position information due to setting errors of a detection recording sheet by a user can be prevented.

The pattern code 90 includes information indicating the side (the first side or the second side) of the detection recording sheet. In image formation of the detection image KG on both sides of the detection recording sheet, the pattern code 90 may include information indicating print information such as a print page number. In FIG. 21, the pattern code 90 is depicted as a bar code. However, the pattern code 90 is not limited thereto but may be a Quick Response (QR) code (trade mark) and other image patters as long as the code is readable to be discriminated.

Further, as illustrated in FIG. 21, the detection recording sheet further includes a display image 91 printed thereon to prevent a sheet setting error. This display image 91 includes an arrow with letters therein to indicate the setting direction of the detection recording sheet (i.e., the leading end in the sheet conveying direction) and the side of the detection recording sheet (i.e., the first side as a front side). By printing the images of the above-described information on the detection recording sheet, when a user can place the detection recording sheet in the specified sheet tray such that the front side having the letters "FRONT" faces up and a leading end of the image of the arrow directs the leading end of the detection recording sheet in the sheet conveying direction. Accordingly, sheet setting errors can be prevented.

Figure 22:
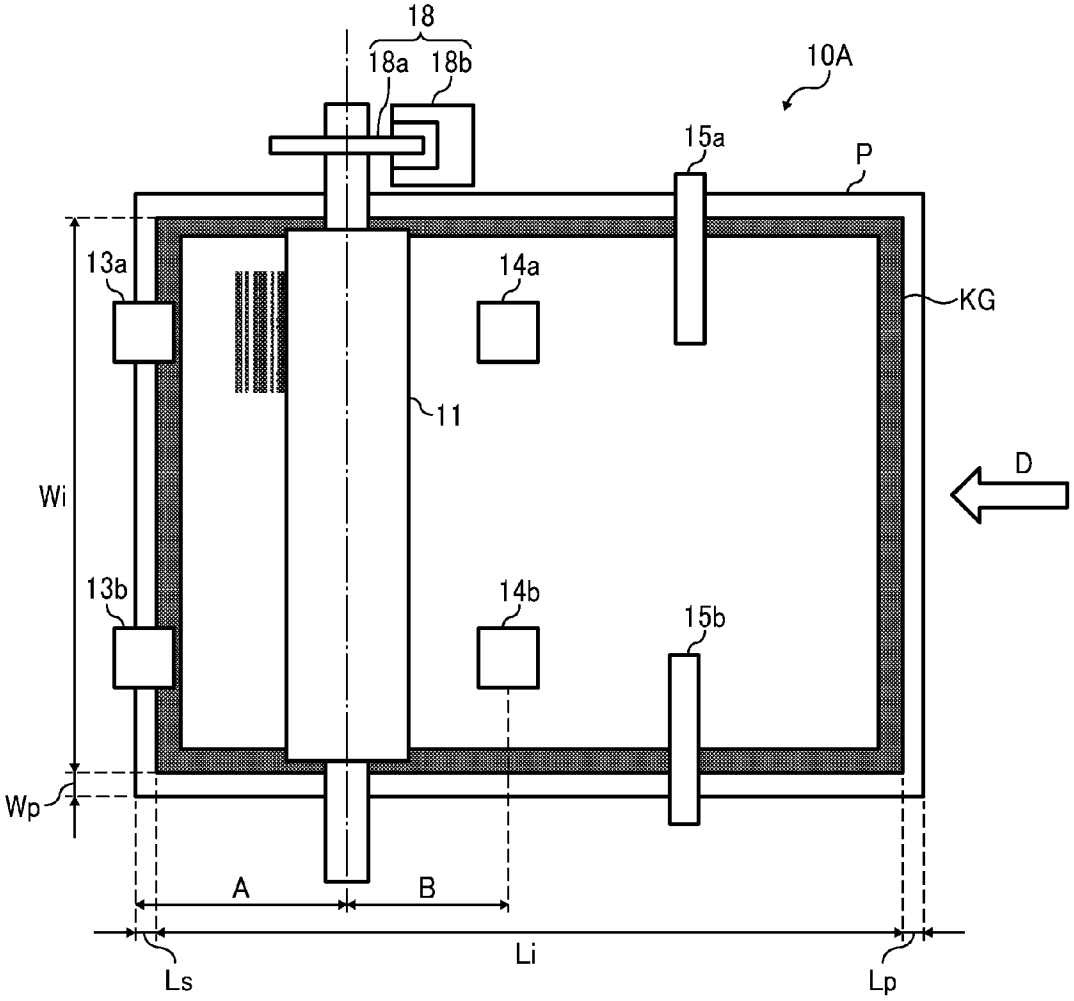
FIG. 22 is a diagram illustrating an operation in which the detection recording sheet with the pattern code and the reference image passes through the position detecting device according to the variation.

FIG. 22 is a diagram illustrating a state in which the detection recording sheet with the pattern code 90 and the detection image KG passes through the position detecting device 10A according to this variation.

Figure 23:
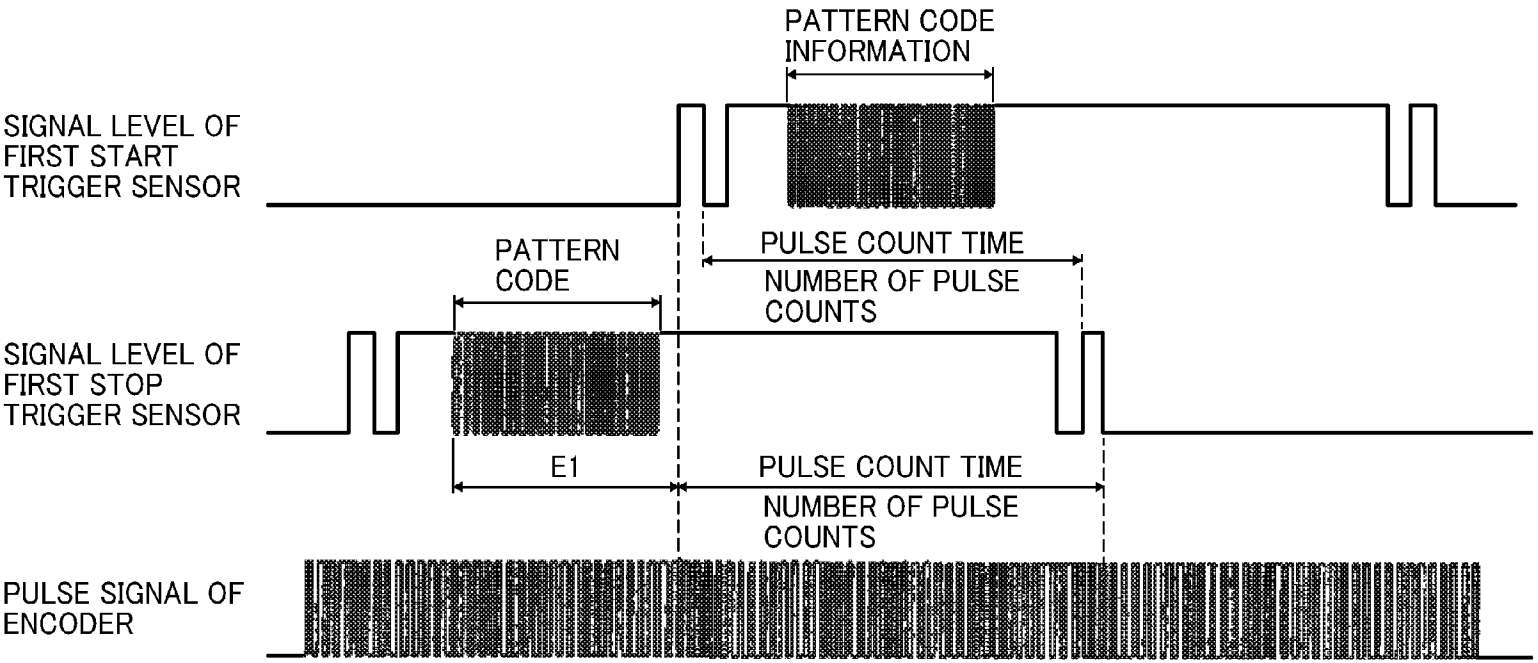
FIG. 23 is a diagram illustrating outputs of a first start trigger sensor, a first stop trigger sensor, and a rotary encoder when the detection recording sheet with the pattern code and the detection image formed thereon passes through the position detecting device according to the variation.

FIG. 23 is a diagram illustrating outputs of the first start trigger sensor 13*a*, the first stop trigger sensor 14*a*, and the rotary encoder 18 when the detection recording sheet with the pattern code 90 and the detection image KG formed thereon passes through the position detecting device 10A according to the variation.

As illustrated in FIG. 22, when the pattern code 90 is printed on a reading line of the first start trigger sensor 13*a* and the first stop trigger sensor 14*a*, the pattern code 90 passes by the first stop trigger sensor 14*a*. At this time, the first stop trigger sensor 14*a* outputs a predetermined output waveform pattern E1, which is similar or identical to a waveform pattern output by the first start trigger sensor 13*a* as illustrated in FIG. 23. The controller 20 detects the information indicating the side and page number of the detection recording sheet based on the output waveform pattern E1. The controller 20 determines the output waveform pattern E1 by counting the number of switching the outputs and the switching time. Then, the controller 20 stores the detected information of the side of the detection recording sheet and the page number of the detection recording sheet by associating with the image position information (the leading end margin length L1, the image length L2, the trailing end margin length L3, the width margin length W1, and the image width W2) to be detected later. It is to be noted that, in FIG. 22, a leading end margin length Ls corresponds to the leading end margin length L1, an image length Lp corresponds to the image length L2, a trailing end margin length Li corresponds to the trailing end margin length L3, a width margin length Wp corresponds to the width margin length W1, and an image width Wi corresponds to the image width W2.

In the configuration according to this variation, the stop trigger sensor 14 detects the pattern code 90. However, the configuration is not limited thereto. For example, different from the stop trigger sensor 14, another sensor dedicated to detection of the pattern code 90 may be employed.

Figure 24:
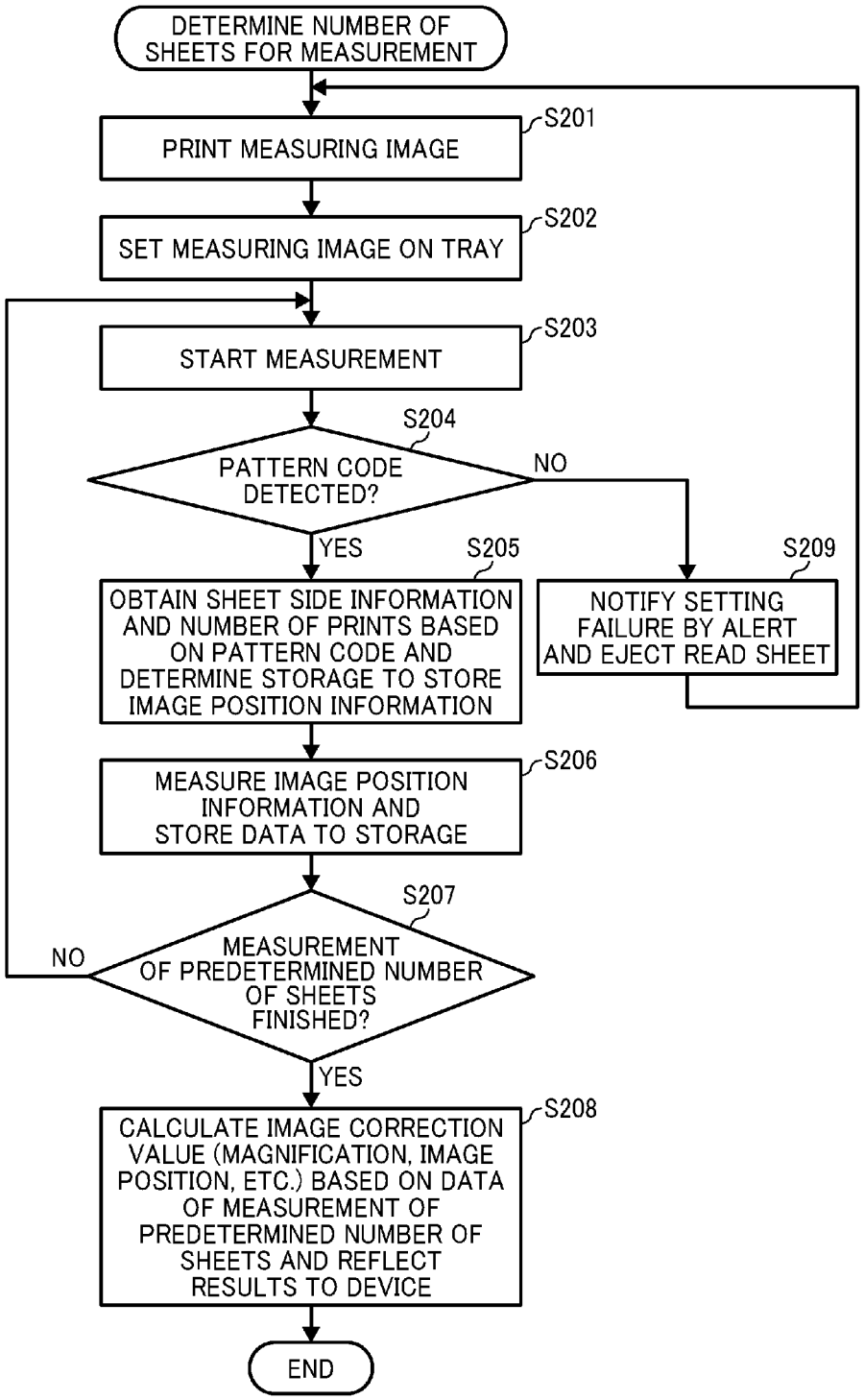
FIG. 24 is a flowchart of an example of the control flow of the misregistration correction mode when the pattern code is formed on the detection recording sheet.

FIG. 24 is a flowchart of an example of a control flow of the adjustment mode of image shift on both sides of a recording sheet when the pattern code 90 is formed on the detection recording sheet P.

Similar to the above-described configurations, the detection recording sheet having an image illustrated in FIG. 21 is set in a selected sheet tray. As the measurement of image position information is started, in steps S201 through S203, the controller 20 determines whether the first stop trigger sensor 14*a* has detected the pattern code 90 at a predetermined timing, in step S204. The predetermined timing is a period of time from when the first stop trigger sensor 14*a* detected the leading end of the detection recording sheet in the sheet conveying direction until the first start trigger sensor 13*a* and the second start trigger sensor 13*b* detect the leading end of the detection recording sheet in the sheet conveying direction.

For example, when a user does not set the detection recording sheet in a specified sheet tray properly, the first stop trigger sensor 14*a* does not detect the pattern code 90 at the timing. Therefore, when the first stop trigger sensor 14*a* did not detect the pattern code 90 at the predetermined timing (NO in step S204), the display 8*a* displays an alert message informing that the detection recording sheet is not set correctly.

Further, the audio device such as a speaker alerts with sound to notify the user that the detection sheet is not set properly, and the detection sheet is output, in step S209.

By contrast, when the first stop trigger sensor 14*a* detected the pattern code 90 (YES in step S204) at the predetermined timing, the controller 20 obtains print information on the printed side (the first side or the second side) of the detection recording sheet and the page number indicating on which page the pattern code 90 is printed. Then, the controller 20 selects and determines a memory to store the image position information to be measured later based on the obtained print information, in step S205. Then, as described above, the controller 20 measures the image position information (i.e., the leading end margin length L1, the image length L2, the trailing end margin length L3, the width margin length W1, and the image width W2) and stores the obtained image position information to the selected memory, in step S206. Accordingly, the information indicated by the pattern code 90 and the image position information are associated with each other and stored.

Then, the controller 20 determines whether or not the image position information by the specified number of detection recording sheets is obtained, in step S207. When the image position information by the specified number of detection recording sheets is not obtained (NO in step S207), the process goes back to step S203 and continues the operations following the control flow in FIG. 24. When the image position information by the specified number of detection recording sheets is obtained (YES in step S207), the controller 20 calculates the positional shift amount and the magnification error based on the image position information, and further calculates the positional shift adjustment amount based on the positional shift amount and the magnification error correction amount based on the magnification error, in step S208.

Accordingly, by forming a pattern code, associating print information and image position information with each other, and storing the information in a selected memory, the information can be used for analyzing machine failure. Specifically, information associating the print information and the image position information with each other is transmitted to a developer via network communications. The developer analyzes the information associating the print information and the image position information with each other via the network communications to find machine failure, thereby taking the countermeasures. For example, when the image position information of a first detection recording sheet is constantly greater in magnification error than other image position information of second and subsequent detection recording sheets, a problem is expected at the beginning of the alternate printing period in the interleaf control. Therefore, an appropriate countermeasure can be taken. Accordingly, an image forming apparatus capable of highly precise duplex printing can be provided.

Figure 25:
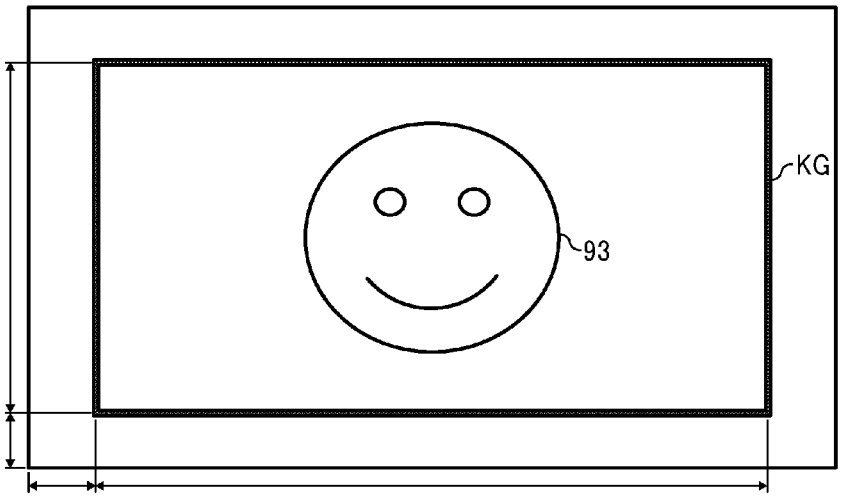
FIG. 25 is a diagram illustrating a detection recording sheet on which a print target image and a reference image are formed.

Further, as illustrated in FIG. 25, by operating the control panel 8, an image 93 can be formed on the recording sheet P together with the detection image KG such as a frame line image. By so doing, when an actual image formed by the user is prepared on the recording sheet P, the positional shift amount and the magnification error can be calculated, and therefore can be corrected highly precisely.

Figure 26:
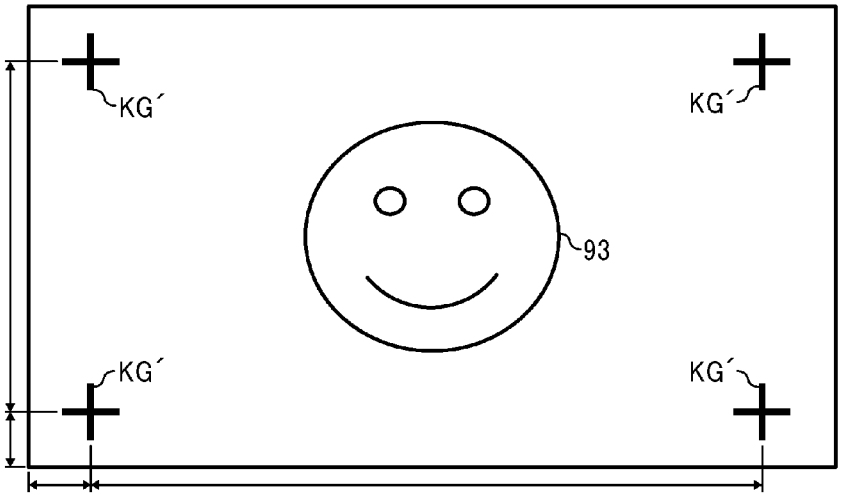
FIG. 26 is a diagram illustrating a detection recording sheet on which a print target image and detection marks are formed.

Further, as illustrated in FIG. 26, marks K' such as cross marks can be formed as a reference image, instead of the frame line image. In this case, the marks K' are formed along reading lines of the start trigger sensor 13 and the stop trigger sensor 14.

This configurations according to the above-described embodiments are not limited thereto. This disclosure can achieve the following aspects effectively.

Aspect 1.

An image forming apparatus (for example, the image forming apparatus 100) in which an image forming device (for example, the process units 2Y, 2M, 2C, and 2K) can form images on both first and second sides, that is, a first image on a first side and a second image on a second side of a recording medium (for example, the recording sheet P) includes a position detector (for example, the position detecting device 10 and the position detecting device 10A) and a controller (for example, the controller 20). The position detector is disposed downstream from the image forming device. The position detector is configured to detect a position of the first image on the first side of the recording medium and a position of the second image on the second side of the recording medium. Based on the detection results obtained by the position detector, the controller is configured to perform at least one of an image position correction in which the first image on the first side of the recording medium and the second image on the second side of the recording medium are matched and a magnification error correction in which a magnification error of one of the first image on the first side of the recording medium and the second image on the second side of the recording medium relative to the other of the first image and the second image is calculated and corrected.

In Aspect 1, the position detector detects the position of the first image on the first side of the recording medium and the position of the second image on the second side of the recording medium. According to the configuration, a user can be saved from manually measuring and inputting the positions of the first and second images on both sides of the recording medium, and therefore a load applied to the user can be reduced.

Further, the position detector automatically detects the positions of the first and second images on the recording medium. Therefore, different from the operations performed by the user manually, the positions of the first and second images on the recording medium can be obtained and grasped precisely without generating human errors such as measurement errors and input errors.

Further, the image position correction and the magnification error correction are performed based on the position of the first image on the first side of the recording medium and the position of the second image on the second side of the recording medium. Therefore, when compared with a configuration in which the image position correction and the magnification error correction are performed based on the position of the first image on the first side of the recording medium, the configuration according to the present embodiment can match the position and size of the images on the recording medium more precisely.

Aspect 2.

According to Aspect 1, the image forming apparatus in Aspect 2 further includes a housing (for example, the housing 100*a*), a sheet feeder (for example, the sheet feeding device 7), and a sheet setting detector (for example, a device to detect opening and closing of the first sheet container 101 and the second sheet container 102. In Aspect 2, the setting error restraint controller 28). The sheet feeder includes a sheet loader (for example, the first sheet container 101 and the second sheet container 102) configured to load the recording medium. The sheet feeder is configured to feed the recording medium loaded on the sheet loader toward the image forming device. The sheet setting detector is configured to detect whether the recording medium is loaded on the sheet loader. The position detector is disposed on a sheet conveying passage (for example, the pre-transfer sheet conveying passage 31) through which the recording medium passes in the housing. The controller is configured to cause the sheet setting detector to detect that the recording medium having the first image on the first side and the second image on the second side is set on the sheet loader after the recording medium having the first image on the first side and the second image on the second side is output to an outside of the housing, the sheet feeder to teed the recording medium toward the image forming device, and the position detector to detect a position of the first image on the first side of the recording medium and a position of the second image on the second side of the recording medium.

Accordingly, the image forming apparatus can detect the position of the position of the first image on the first side of the recording medium and the position of the second image on the second side of the recording medium.

Aspect 3.

According to Aspect 2, the sheet loader is attached openably closable to the housing and the sheet setting detector detects whether the recording medium is set on the sheet loader, based on opening and closing of the sheet loader.

Accordingly, when the recording medium having the first and second images on the first and second sides, respectively, is set on the sheet loader, the recording medium loaded on the sheet loader is conveyed automatically, and the position of the first image on the first side of the recording medium and the position of the second image on the second side of the recording medium are detected.

Aspect 4.

According to Aspect 2 or Aspect 3, the sheet loader includes a sheet moving device (for example, the sheet moving device 130 including the bottom plate 110 and the bottom plate driving device 120 provided to each of the first sheet container 101 and the second sheet container 102) configured to move the recording medium between a sheet feeding position at which the recording medium is fed forward and the sheet retreating position at which the recording medium is separated from the sheet feeding position. The controller is configured to cause the sheet feeder to start feeding the recording medium having the first image on the first side and the second image on the second side on arrival of the recording medium at the sheet feeding position from the sheet retreating position by the sheet moving device.

According to this configuration, as described in the above-described embodiment, even when the recording medium having the first and second images is set in a sheet loader different from a specified sheet loader, the image forming apparatus does not start sheet feeding of the recording medium, and therefore an operation failure or malfunction of the image forming apparatus due to sheet setting errors can be prevented.

Further, by performing a known paper end detection, the setting of the recording medium having the images on both sides can be detected.

Further, when compared with a configuration including a sheet setting detector that detects the setting of the recording medium having the images on both sides, the configuration according to the present embodiment can reduce costs of the image forming apparatus.

Aspect 5.

According to Aspect 2 or Aspect 3, the controller (for example, the controller 20) is configured to cause the sheet feeder to start feeding the recording medium having the first image on the first side and the second image on the second side based on an instruction to start feeding the recording medium by the sheet moving device.

According to this configuration, a user can obtain the image position information at any timing.

Accordingly, after checking that the recording medium having the images on both sides is set in the sheet loader, the user can obtain the image position information. Therefore, an operation failure or malfunction of the image forming apparatus causing when obtaining the image position information can be prevented.

Aspect 6.

According to Aspect 4 or Aspect 5, the controller (for example, the controller 20) is configured to stop feeding the recording medium having the first image on the first side and the second image on the second side when a temperature of the recording medium is above a predetermined temperature.

According to this configuration, the image position information can be obtained after the temperature of the recording medium that has been contracted due to heat generated by the fixing device is lowered and the shape of the recording medium is stabled. Accordingly, the image information can be obtained with high precision.

Aspect 7.

According to any one of Aspect 2 through Aspect 6, the image forming apparatus further including a setting error prevention controller (for example, the setting error prevention controller 28 that instructs the process units 2Y, 2M, 2C, and 2K to form the image including a notification message as illustrated in FIG. 13, the light emitting part 39 mounted on the sheet container in which the detection recording sheet is set, the display 8*a* of the control panel 8, and the setting error prevention controller 28 that locks sheet trays other than the specified sheet tray as illustrated in FIG. 14) configured to prevent a setting error on the sheet loader of the recording medium having a detection image (for example, the detection image KG) to be detected by the position detector (for example, the position detecting device 10).

According to this configuration, the sheet setting error in which the user incorrectly sets of the recording medium (for example, the detection recording sheet) having the detection image (for example, the detection image KG) to be detected by the position detector (for example, the position detecting device 10) can be prevented.

Aspect 8.

According to Aspect 2 through Aspect 7, the sheet loader of the sheet feeder (for example, the sheet feeding device 7) includes multiple sheet loaders (for example, the first sheet container 101 and the second sheet feed container 102). One of the multiple sheet loaders is a specified sheet loader configured to load the recording medium having a detection image (for example, the detection image KG) on both sides to be detected by the position detector (for example, the position detecting device 10). The setting error prevention controller 28 includes a guide (in the present embodiment, the setting error prevention controller 28 or a device to instruct the process units 2Y, 2M, 2C, and 2K to form the image on the detection recording sheet as illustrated in FIG. 13, the light emitting part 39 mounted on the sheet container in which the detection recording sheet is set, and the display 8*a* of the control panel 8 as illustrated in FIG. 14) configured to guide the recording medium having the detection image to be set to the specified sheet loader.

According to this configuration, the sheet setting error in which the user incorrectly sets of the recording medium (for example, the detection recording sheet) having the detection image (for example, the detection image KG) to be detected by the position detector (for example, the position detecting device 10) can be prevented.

Aspect 9.

According to Aspect 1 through Aspect 8, the image forming apparatus further includes a sheet feeder (for example, the sheet feeding device 7), a sheet reversing device (including, for example, the conveyance direction switching device 50, the re-entry passage 54, the switchback passage 55, and the post-switchback passage 56), and a sheet conveyance controller (for example, the controller 20). The sheet feeder includes multiple sheet loaders (for example, the first sheet container 101 and the second sheet feed container 102) configured to load the recording medium. The sheet feeder is configured to feed the recording medium loaded on the sheet loader toward the image forming device. The sheet reversing device is configured to reverse the recording medium and convey the recording medium to the image forming device again. The sheet conveyance controller is configured to convey recording media having an image on one side to the sheet reversing device and then to perform a sheet conveyance control in which the recording media conveyed to the sheet reversing device and recording media loaded on the sheet loader are alternately conveyed to the image forming device. The controller is configured to cause the image forming device to form a detection image (for example, the detection image KG) on both sides of the recording medium to be detected by the position detector, during the sheet conveyance control in the sheet conveyance control.

According to this configuration, as described in the above-described examples, the detection image to be detected by the position detector can be formed on both sides of the recording medium in the sheet conveyance control, in which the quantity of heat applied by the fixing device is stable. Accordingly, the magnification error can be detected accurately, and therefore the magnification error correction can be performed with high precision.

Aspect 10.

According to Aspect 9, the image forming apparatus further includes a first output tray (for example, the purge tray 58) and a second output tray (for example, the sheet output tray 53). The first output tray is configured to stack the recording medium not having the detection image. The second output tray is different from the first output tray and configured to stack the recording medium having the detection image.

According to this configuration, as described in the embodiments above, the user does not sort the detection recording medium having an image (for example, the detection image KG to be detected by the position detector (for example, the position detecting device 10) and the recording medium other than the detection recording medium. Therefore, the user can be saved from doing the sorting.

Further, when obtaining further image position information, the entrance of the recording medium other than the detection recording medium having the image to be detected by the position detector can be prevented.

Aspect 11.

According to Aspect 9 or Aspect 10, the controller is configured to cause the image forming device to form the detection image on both sides of recording media to be detected by the position detector and not to form the detection image on recording media not to be detected by the position detector.

According to this configuration, as described in the embodiments above, the sheet conveyance control (i.e., the interleaf control) does not form an image on a recording medium other than the recording medium having the image on both sides and conveyed in the first side consecutive printing period and in the second side consecutive printing period, and therefore the recording medium not having an image can be reused. Accordingly, the degree of loss of the recording media can be prevented.

Aspect 12.

According to any one of Aspect 1 through Aspect 11, the image forming apparatus further includes a control panel configured to set a number of recording media to detect the position of the first image on the first side of the recording medium and the position of the second image on the second side of the recording medium. In other words, a user can input the number of recording media to the control panel, so that the position detector (for example, the position detecting device 10) can detect the position of the first image on the first side and the position of the second image on the second side.

According to this configuration, in order to enhance the accuracy in position of the first side and the second side of the recording medium and the equality of the first side and the second side of the recording medium, the user can increase the number of recording media by which the position detector detects the position of the first image on the first side of a recording medium and the position of the second image on the second side of the recording medium. By contrast, in order to lower the level of accuracy of the first side and the second side of the recording medium, in order to reduce the time of adjustment, or in order to decrease the cost of adjustment, the user can decrease the number of recording media.

By so doing, any misregistration of image positions on both sides of a recording sheet corrected according to user's demands.

Aspect 13.

According to any one of Aspect 1 through Aspect 12, the controller is configured to cause to the image forming device to form a dedicated pattern image on both the first side and the second side of the recording medium and cause the position detector to detect a position of the dedicated pattern image on the recording medium.

According to this configuration, by detecting the dedicated pattern image (for example, the detection image KG), the image position information can be obtained with high precision under a simple control.

Aspect 14.

According to Aspect 13, the dedicated pattern image (for example, the detection image KG) is a single color image.

According to this configuration, the identical output value can be obtained when the dedicated pattern image is detected, and therefore the image position information can be obtained with high precision under a simple control.

Further, by forming the dedicated pattern image is formed with a color (for example, black) having a large contrast difference from the recording medium, the image position information can be obtained with high precision.

Aspect 15.

According to Aspect 13 or Aspect 14, when the position detector does not detect the position of the detected pattern image on the recording medium at a predetermined timing, the controller is configured to cause the position detector to stop the detection.

According to this configuration, as described in the embodiments above, even when a recording medium that is not the detection recording medium having any dedicated pattern image (for example, the detection image KG) on both the first and second sides is loaded together with the detection recording medium in the sheet loader, the image information of the detection recording medium having the dedicated pattern image can be obtained.

Aspect 16.

According to any one of Aspect 1 through Aspect 15, the controller is configured to cause the image forming device to form a dedicated pattern image on both the first side and the second side of the recording medium and causes the position detector to detect a position of the dedicated pattern image on the recording medium. In addition to the dedicated pattern image, the controller is configured to cause the image forming device to form one of a selected image and an image pattern to detect a correct image position by the position detector, on at least one of the first side and the second side of the recording medium.

According to this configuration, as described in the embodiments above, by forming the selected image specified by the user, an actual print image can be formed and adjusted, for example. Therefore, a highly accurate adjustment can be performed.

Further, by forming an image (for example, the pattern code 90) with which the position detector performs a correct image position, incorrect acquisition of the image position information can be prevented.

Aspect 17.

According to any one of Aspect 1 through Aspect 16, the image forming apparatus further includes a fixing device (for example, the fixing device 40) configured to fix the image to the recording medium by application of heat and pressure. The controller is configured to control the fixing device such that a quantity of heat applied by the fixing device to the recording medium when the position detector detects the position of the first image on the first side of the recording medium and the position of the second image on the second side of the recording medium is smaller than a quantity of heat applied to the recording medium when the image is formed on both the first side and the second side of the recording medium.

According to this configuration, as described in the embodiments above, a decrease in size of the recording medium affected by heat applied by the fixing device when the position detector (for example, the position detecting device 10) detects the position of the first image on the first side of the recording medium and the position of the second image on the second side of the recording medium can be prevented. Accordingly, the image position information can be obtained with high precision.

Aspect 18.

According to any one of Aspect 1 through Aspect 17, the position detector detects the position of the first image on the first side of the recording medium and the position of the second image on the second side of the recording medium. The controller is configured to calculate a first travel direction margin length (for example, the leading end margin length L1(1)) from one end of the recording medium to one end of the first image on the first side of the recording medium in the sheet conveying direction and a first width margin length (for example, the width margin length W1(1)) from one end of the recording medium to one end of the first image in a width direction of the recording medium, based on a detection result obtained by the position detector, calculate a second travel direction margin length (for example, the leading end margin length L1(2)) from one end of the recording medium to one end of the second image on the second side of the recording medium in the sheet conveying direction and a second width margin length (for example, the width margin length W1(2)) from one end of the recording medium to one end of the second image of the recording medium in the width direction, based on the detection result obtained by the position detector, calculate a positional shift amount of one of the first image relative to the second image, the second image relative to the first image, the first image relative to an ideal image, and the second image relative to the ideal image, based on the first travel direction margin length, the second travel direction margin length, the first width margin length, and the second width margin length, and correct an image forming position based on the calculated positional shift amount.

Accordingly, the position and size of the image formed on the first side of the recording sheet P are matched with the position and size of the image formed on the second side of the recording sheet P.

Aspect 19.

According to any one of Aspect 1 through Aspect 18, the position detector detects the position of the first image on the first side of the recording medium and the position of the second image on the second side of the recording medium. The controller is configured to calculate a first image length (for example, the image length L2(1)) and a first image width (for example, the image width W2(1)) of the first image on the first side of the recording medium based on a detection result obtained by the position detector, calculate a second image length (for example, the image length L2(2)) and a second image width (for example, the image width W2(2)) of the second image on the second side of the recording medium based on the detection result obtained by the position detector, calculate a magnification error of one of the first image relative to the second image, the second image relative to the first image, the first image relative to an ideal image, and the second image relative to the ideal image based on the first image length, the second image length, the first image width, and the second image width, and correct an image magnification of the image on the recording medium based on the calculated magnification error.

According to this configuration, the size of the image on the first side can be matched with the image on the second side accurately.

Aspect 20.

In Aspect 20, a program product includes a computer-usable medium having computer-readable program code embodied on the medium for causing a computer to perform an image processing method, and the method includes forming a first image on a first side of a recording medium and a second image on a second side of the recording medium, detecting a position of the first image and a position of the second image, and matching at least one of position and size of the first image on the first side and the second image on the second side based on a detection result of the detecting.

Accordingly, the position and size of the image formed on the first side image of the recording sheet are matched with the position and size of the image formed on the second face of the recording sheet accurately.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. An image forming apparatus comprising:

an image forming device configured to form a first image on a first side of a recording medium and a second image on a second side of the recording medium;

a position detector disposed downstream from the image forming device in a sheet conveying direction, the position detector being configured to detect a position of the first image on the first side of the recording medium to obtain a first detection result and a position of the second image on the second side of the recording medium to obtain a second detection result;

a controller configured to perform, based on the first and second detection results obtained by the position detector, at least one of an image position correction in which the first image on the first side and the second image on the second side are matched and a magnification error correction in which a magnification error of one of the first image on the first side and the second image on the second side, relative to another of the second image on the second side and the first image on the first side, is calculated and corrected;

a housing;

a sheet feeder including a sheet loader configured to load the recording medium, the sheet feeder being configured to feed the recording medium loaded on the sheet loader toward the image forming device; and a sheet setting detector configured to detect whether the recording medium is set on the sheet loader, wherein the position detector is disposed on a sheet conveying passage through which the recording medium passes in the housing, and wherein the controller is configured to cause, the sheet setting detector to detect that the recording medium, including the first image on the first side and the second image on the second side, is set on the sheet loader after the recording medium including the first image on the first side and the second image on the second side is output to an outside of the housing, the sheet feeder to feed the recording medium toward the image forming device, and the position detector to detect the position of the first image on the first side of the recording medium and the position of the second image on the second side of the recording medium.

2. The image forming apparatus according to of claim 1, wherein the sheet loader is attached to the housing and is openable and closable, and wherein the sheet setting detector is configured to detect whether the recording medium is set on the sheet loader, based on whether or not the sheet loader is open or closed.

3. The image forming apparatus of claim 1, wherein the sheet loader includes a sheet moving device configured to move the recording medium between a sheet feeding position at which the recording medium is fed forward and a sheet retreating position at which the recording medium is separated from the sheet feeding position, and wherein the controller is configured to cause the sheet feeder to start feeding the recording medium including the first image on the first side and the second image on the second side on arrival of the recording medium at the sheet feeding position from the sheet retreating position by the sheet moving device.

4. The image forming apparatus of claim 3, wherein the controller is configured to stop feeding the recording medium including the first image on the first side and the second image on the second side when a temperature of the recording medium is above a threshold temperature.

5. The image forming apparatus of claim 1, wherein the controller is configured to cause the sheet feeder to start feeding the recording medium including the first image on the first side and the second image on the second side based on an instruction to start feeding the recording medium by the sheet feeding device.

6. The image forming apparatus of claim 1, further comprising a setting error prevention controller configured to prevent a setting error on the sheet loader of the recording medium including a detection image to be detected by the position detector.

7. The image forming apparatus of claim 1, wherein the sheet feeder includes multiple sheet loaders, including the sheet loader, wherein one of the multiple sheet loaders is a specified sheet loader configured to load the recording medium including a detection image on both sides to be detected by the position detector, and wherein the setting error prevention controller includes a guide configured to guide the recording medium including the detection image to be set to the specified sheet loader.

8. The image forming apparatus of claim 1, further comprising:

a sheet feeder including a sheet loader configured to load the recording medium, the sheet feeder configured to feed the recording medium loaded on the sheet loader toward the image forming device;

a sheet reversing device configured to reverse the recording medium and convey the recording medium to the image forming device again; and a sheet conveyance controller configured to convey recording media including an image on one side to the sheet reversing device and then to perform a sheet conveyance control in which the recording media conveyed to the sheet reversing device and new recording media loaded on the sheet loader are alternately conveyed to the image forming device, wherein the controller is configured to cause the image forming device to form a detection image to be detected by the position detector on both sides of the recording medium, during the sheet conveyance control in the sheet conveyance control.

9. The image forming apparatus of claim 8, further comprising:

a first output tray configured to stack the recording medium not including the detection image; and a second output tray different from the first output tray, the second output tray configured to stack the recording medium including the detection image.

10. The image forming apparatus of claim 8, wherein the controller is configured to cause the image forming device to form the detection image on both sides of recording media to be detected as detection recording media by the position detector and not to form the detection image on recording media to be detected as non-detection recording media by the position detector.

11. The image forming apparatus of claim 1, further comprising a control panel to set a number of recording media to detect the position of the first image on the first side of the recording medium and the position of the second image on the second side of the recording medium.

12. The image forming apparatus of claim 1, wherein the controller is configured to cause to the image forming device to form a dedicated pattern image on both the first side and the second side of the recording medium and to cause the position detector to detect a position of the dedicated pattern image on the recording medium.

13. The image forming apparatus of claim 12, wherein the dedicated pattern image is a single color image.

14. The image forming apparatus of claim 12, wherein, when the position detector does not detect the position of the detected pattern image on the recording medium at a certain timing, the controller is configured to cause the position detector to stop the detection.

15. The image forming apparatus of claim 1, wherein the controller is configured to cause the image forming device to form a dedicated pattern image on both the first side and the second side of the recording medium and to cause the position detector to detect a position of the dedicated pattern image on the recording medium, and wherein, in addition to the dedicated pattern image, the controller is configured to cause the image forming device to form one of a selected image and an image pattern to detect a correct image position by the position detector, on at least one of the first side and the second side of the recording medium.

16. The image forming apparatus of claim 1, further comprising a fixing device configured to fix the image to the recording medium by application of heat and pressure, wherein the controller is configured to cause the fixing device to apply a quantity of heat, applied to the recording medium when the position detector detects the position of the first image on the first side of the recording medium and the detects position of the second image on the second side of the recording medium, is relatively smaller than a quantity of heat applied to the recording medium when the fixing device fixes the first image to the the first side of the recording medium and fixes the second image to the second side of the recording medium.

17. The image forming apparatus of claim 1, wherein the position detector is configured to detect the position of the first image on the first side of the recording medium and the position of the second image on the second side of the recording medium, and wherein the controller is configured to, calculate a first travel direction margin length from one end of the recording medium to one end of the first image on the first side of the recording medium in the sheet conveying direction and a first width margin length from one end of the recording medium to one end of the first image of the recording medium in a width direction, based on a detection result obtained by the position detector, calculate a second travel direction margin length from one end of the recording medium to one end of the second image on the second side of the recording medium in the sheet conveying direction and a second width margin length from one end of the recording medium to one end of the second image of the recording medium in the width direction, based on the detection result obtained by the position detector, calculate a positional shift amount of one of the first image relative to the second image, the second image relative to the first image, the first image relative to an ideal image, and the second image relative to the ideal image, based on the first travel direction margin length, the second travel direction margin length, the first width margin length, and the second width margin length, and correct an image forming position based on the calculated positional shift amount.

18. The image forming apparatus of claim 1, wherein the position detector is configured to detect the position of the first image on the first side of the recording medium and the position of the second image on the second side of the recording medium, and wherein the controller is configured to, calculate a first image length and a first image width of the first image on the first side of the recording medium based on a detection result obtained by the position detector, calculate a second image length and a second image width of the second image on the second side of the recording medium based on the detection result obtained by the position detector, calculate a magnification error of one of the first image relative to the second image, the second image relative to the first image, the first image relative to an ideal image, and the second image relative to the ideal image based on the first image length, the second image length, the first image width, and the second image width, and correct an image magnification of the image on the recording medium based on the calculated magnification error.

19. A non-transitory program product comprising a non-transitory computer-usable medium including computer-readable program code embodied on the medium for causing a computer to perform an image processing method, the image processing method comprising:

forming a first image on a first side of a recording medium and a second image on a second side of the recording medium in an image forming device;

detecting that the recording medium, including the first image on the first side and the second image on the second side, is set on a sheet loader after the recording medium including the first image on the first side and the second image on the second side is output;

feeding the recording medium, loaded on the sheet loader, toward the image forming device;

detecting a position of the first image on the first side of the recording medium to obtain a first detection result and a position of the second image on the second side of the recording medium to obtain a second detection result;

matching at least one of position and size of the first image on the first side and the second image on the second side based on the first and second detection results of the detecting; and calculating and correcting a magnification error of one of the first image on the first side and the second image on the second side, relative to another of the second image on the second side and the first image on the first side.

20. An image processing method, comprising:

forming a first image on a first side of a recording medium and a second image on a second side of the recording medium in an image forming device;

detecting that the recording medium, including the first image on the first side and the second image on the second side, is set on a sheet loader after the recording medium including the first image on the first side and the second image on the second side is output;

feeding the recording medium, loaded on the sheet loader, toward the image forming device;

detecting a position of the first image on the first side of the recording medium to obtain a first detection result and a position of the second image on the second side of the recording medium to obtain a second detection result;

matching at least one of position and size of the first image on the first side and the second image on the second side based on the first and second detection results of the detecting; and calculating and correcting a magnification error of one of the first image on the first side and the second image on the second side, relative to another of the second image on the second side and the first image on the first side.

* * * * *